US007508368B2

(12) United States Patent
Miyazaki

(10) Patent No.: US 7,508,368 B2
(45) Date of Patent: Mar. 24, 2009

(54) DRIVE VOLTAGE GENERATOR CIRCUIT FOR DRIVING LCD PANEL

(75) Inventor: Kiyoshi Miyazaki, Kawasaki (JP)

(73) Assignee: NEC Electronics Corporation, Kanagawa (JP)

( * ) Notice: Subject to any disclaimer, the term of this patent is extended or adjusted under 35 U.S.C. 154(b) by 758 days.

(21) Appl. No.: 11/042,159

(22) Filed: Jan. 26, 2005

(65) Prior Publication Data

US 2005/0162370 A1 Jul. 28, 2005

(30) Foreign Application Priority Data

Jan. 27, 2004 (JP) ..... 2004-018583

(51) Int. Cl.
*G09G 3/36* (2006.01)

(52) U.S. Cl. ..... 345/98; 345/89

(58) Field of Classification Search ..... 345/89, 345/98, 100

See application file for complete search history.

(56) References Cited

U.S. PATENT DOCUMENTS 5,729,246 A * 3/1998 Masuko ..... 345/98

6,762,737 B2 * 7/2004 Kajihara et al. ..... 345/89

FOREIGN PATENT DOCUMENTS

| | | |
|---|---|---|
| JP | 2000-98331 | 4/2000 |
| JP | 2002-108301 | 4/2002 |
| JP | 2002-202745 | 7/2002 |
| KR | 2002-0033072 | 5/2002 |

* cited by examiner

*Primary Examiner*—Kevin M. Nguyen
(74) *Attorney, Agent, or Firm*—Young & Thompson

(57) ABSTRACT

A drive voltage generator circuit is provided for developing drive voltages used for driving an LCD panel. The drive voltage generator circuit is composed of a breeder, a buffer amplifier, a switch circuitry, and a set of first to N-th output terminals on which the drive voltages are developed, respectively. The breeder develops a set of first to N-th different voltages on first to N-th nodes, respectively, N being any integer equal to or more than 2, and the first to N-th voltages being associated with grayscale levels, respectively. The switch circuitry switches connections among an input and an output of the buffer amplifier, the first to N-th nodes, and the first to N-th output terminals.

9 Claims, 19 Drawing Sheets

DRIVE VOLTAGE GENERATOR CIRCUIT FOR DRIVING LCD PANEL

BACKGROUND OF THE INVENTION

1. Field of the Invention

The present invention relates to drive voltage generator circuits, LCD (liquid crystal display) drivers, and liquid crystal display apparatuses. More particularly, the present invention relates to generation of drive voltages (which may be called grayscale voltages) within LCD drivers.

2. Description of the Related Art

Recent mobile electronic apparatus, such as cellular phones, often incorporate liquid crystal display apparatuses for man-machine interface. Requirements of liquid crystal display apparatuses incorporated within mobile electronic apparatuses include reduction in the circuit size and power consumption of hardware implementations. One approach for reducing the circuit size and power consumption is to incorporate a reduced number of circuitries within liquid crystal display apparatuses.

A typical liquid crystal display apparatus is composed of an LCD driver and an LCD panel. A typical LCD driver includes a grayscale voltage generator and a drive circuitry. The grayscale voltage generator generates a set of different grayscale voltages. The drive circuitry selects the grayscale voltages in response to pixel data, which are digital data representative of desired grayscale levels of the associated pixels, and outputs the selected grayscale voltages to drive the associated signal lines (or data lines) within the LCD panel.

In order to drive signal lines within an LCD panel immediately, driving the signal lines are often achieved by using buffer amplifiers incorporated within the LCD driver, which are each composed of a source follower having a gain of 1.

In a typical LCD driver configuration, as disclosed as a prior art in Japanese Laid-Open Patent Application No. P2002-108301A, buffer amplifiers are provided for respective LCD driver outputs used for providing desired drive voltages for signal lines of an LCD panel.

FIG. 1 illustrates the disclosed LCD driver structure. The disclosed LCD driver is composed of a serial-parallel shift register 1, a set of m data latches 2, a load latch circuit 3, a level shifter 4, a digital/analog (D/A) converter 5, a buffer amplifier circuit 6, and a breeder 7, m being a natural number. The buffer amplifier circuit 6 composed of a set of m buffer amplifiers $\mathbf{6}_1$ to $\mathbf{6}_m$, outputs of which are respectively connected to m signal lines disposed within an LCD panel through a set of m outputs terminals of the LCD driver.

The shift register 1 is used to develop a set of m latch signals in response to an externally inputted shift pulse signal and transfer clock. The shift register 1 sequentially latches and shifts data bits of the shift pulse signal in synchronization with a transfer clock, and thereby develops the set of m latch signals on the parallel outputs.

The data latches 2 are each designed to latch the associated pixel data in synchronization with the associated latch signal.

The load latch circuit 3 latches the outputs of the data latches 2 in response to a load signal at the same timing.

The level shifter 4 provides level shifting between the outputs of the load latch circuit 3 and the inputs of the D/A converter 5.

The breeder 7 divides an external voltage by using a set of serially connected resistors, and thereby generates a set of n ($=2^k$) different grayscale voltages, k being a natural number.

The D/A converter 5 selects one of the grayscale voltages for each signal line in response to the associated pixel data.

The buffer amplifiers $\mathbf{6}_1$ to $\mathbf{6}_m$ receive the associated grayscale voltages from the D/A converter 5, and provide buffering for the received grayscale voltages to develop a set of drive voltages. The drive voltages outputted from the buffer amplifiers $\mathbf{6}_1$ to $\mathbf{6}_m$ are substantially identical to the associated grayscale voltages, received from the D/A converter 5. The drive voltages are outputted to the signal lines of the LCD panel.

One drawback of this LCD driver architecture is that this LCD driver architecture requires increasing the number of the buffer amplifiers $\mathbf{6}_1$ to $\mathbf{6}_m$ for increasing the number of the outputs of the LCD driver. Increasing the screen size and/or fineness of the liquid crystal panel requires increasing the number of the signal lines of the liquid crystal panel, that is, the number of the buffer amplifiers disposed within the LCD driver. The increased number of the buffer amplifiers undesirably increases the circuit size and power consumption of the LCD driver.

In order to solve this drawback, an improved LCD driver structure has been proposed in the aforementioned Japanese Laid-Open Patent Application No. P2002-108301A, which incorporates one buffer amplifier for each grayscale voltage. This effectively allows increasing the number of LCD driver outputs without increasing the number of buffer amplifiers.

FIGS. 2 and 3 illustrate the proposed LCD driver structure. Referring to FIG. 2, the disclosed LCD driver is composed of a serial-parallel shift register 1, a set of m data latches 2, a load latch circuit 3, a level shifter 4, a decoder circuit 21, an output selector circuit 22, a buffer amplifier circuit 6, and a breeder 7; it should be noted that same numerals denote the same, similar, or equivalent elements in the specification. The disclosed LCD driver additionally includes a pixel data enable circuit 23, a pixel mode circuit 24, and an amplifier enable circuit 25.

As shown in FIG. 3, the buffer amplifier circuit 6 and the breeder 7 constitute a drive voltage generator circuit 10 that generates a set of drive voltages associated with grayscale levels, while the load latch circuit 3, the decoder circuit 21, and the output selector circuit 22 constitute a drive circuitry 20 designed to output a selected one of the drive voltages on each output terminal.

The breeder 7 is composed of a set of resistor elements $R_0$ to $R_n$ serially connected between the power supply $V_H$ and ground $V_L$ to generate n different grayscale voltages associated with different grayscale levels; n is the number of available grayscale levels, equal to $2^k$, where k is the number of data bits of each pixel data. The resistor element $R_w$ is connected to the adjacent resistor element $R_{w-1}$ with a node $TP_w$ disposed therebetween, where w is any integer ranging from 1 to n. Such connection provides different voltages on the nodes $TP_1$ to $TP_n$; the voltages developed on the nodes $TP_1$ to $TP_n$ are denoted by numerals $V_1$ to $V_n$, respectively.

The buffer amplifier circuit 6 includes a set of n buffer amplifiers $AM_1$ to $AM_n$ each having a gain of 1. The inputs of the buffer amplifiers $AM_1$ to $AM_n$ are connected to the node $TP_1$ to $Tp_n$, respectively. The buffer amplifiers $AM_1$ to $AM_n$ provide buffering for the grayscale voltages received from the nodes $TP_1$ to $TP_n$, respectively. The buffer amplifiers $AM_1$ to $AM_n$ develops drive voltages on the output terminals, denoted by numerals $LV_1$ to $LV_1$, respectively. The drive voltages developed on the output terminals $LV_1$ to $LV_n$ are ideally identical to the voltages $V_1$ to $V_n$ developed on the nodes $TP_1$ to $TP_n$, respectively. The drive voltages developed on the output terminals $LV_1$ to $LV_n$ are used for driving the signal lines of the LCD panel, denoted by numeral 30 in FIG. 3.

The load latch circuit 3 is composed of a set of m latches $\mathbf{3}_1$ to $\mathbf{3}_m$, and the decoder circuit 21 is composed of a set of m decoders $21_1$ to $21_m$. Additionally, the output selector circuit 22 is composed of a set of multiplexers $22_1$ to $22_m$ that functions as D/A converters. The outputs of the latches $3_1$ to $3_m$ are connected to the inputs of the decoders $21_1$ to $21_m$, respectively. The outputs of the decoders $21_1$ to $21_m$ are connected to the select inputs of the multiplexers $22_1$ to $22_m$, respectively. The outputs of the multiplexers $22_1$ to $22_m$ are connected to the output terminals of the LCD driver, which are denoted by symbols $OUT_1$ to $OUT_m$, respectively. The output terminals $OUT_1$ to $OUT_m$ are connected to the signal lines of the LCD panel 30.

The latches $3_1$ to $3_m$ latch externally inputted k-bit pixel data $D_1$ to $D_m$, respectively, in synchronization with an externally inputted transfer clock CLK. The latched k-bit pixel data $D_1$ to $D_m$ are provided for the decoders $21_1$ to $22_m$.

The decoders $21_1$ to $22_m$ decode the pixel data $D_1$ to $D_m$.

The multiplexers $22_1$ to $22_m$ are each designed to select among the voltages $V_1$ to $V_n$ developed on the output terminals $LV_1$ to $LV_n$ in response to the decoded pixel data $D_1$ to $D_m$, respectively. When a pixel data $D_v$ is "111111" with k=6, v being a natural number ranging from 1 to n, the multiplexer $22_v$ selects the voltage $V_n$ out of the voltages $V_1$ to $V_n$. When a pixel data $D_v$ is "000000", on the other hand, the multiplexer $22_v$ selects the voltage $V_1$ out of the voltages $V_1$ to $V_n$. The multiplexers $22_1$ to $22_m$ provide the selected voltages for the LCD panel 30 through the associated output terminals $OUT_1$ to $OUT_m$.

An advantageous feature of the LCD driver structure shown in FIG. 3 is that the LCD driver is allowed to have an increased number of output terminals without increasing the number of the buffer amplifiers; the number of the buffer amplifiers is limited to the number of the available grayscale levels.

Recent requirements include the increase in the number of available grayscale levels; however, the LCD driver structure shown in FIG. 3 suffers from a problem that the number of the buffer amplifiers is increased in proportion to the number of available grayscale levels. In order to achieve 260k-color display, for example, the LCD driver structure shown in FIG. 3 requires 64 buffer amplifiers; it should be noted that 260k-color display requires 64 grayscale levels for each R, G, B color component. The LCD driver structure shown in FIG. 3 requires 256 or 1024 buffer amplifiers for achieving natural grayscale display, involving 256 ($=2^8$) or 1024 ($2_{16}$) grayscale levels for each R, G, B color component. As described above, the LCD driver structure shown in FIG. 3 requires increasing the number of the buffer amplifiers for increasing the number of available grayscale levels. This undesirably increases the circuit size and power consumption of the hardware implementation of the LCD driver.

Japanese Laid Open Patent Application No. P2000-98331A discloses another LCD driver structure for reducing the number of voltage followers within an LCD driver; however, this LCD driver structure addresses achieving frame-inversion driving of LCD segment display panels with a reduced number of voltage followers, and does not provide grayscale display.

SUMMARY OF THE INVENTION

In an aspect of the present invention, a drive voltage generator circuit is provided for developing drive voltages used for driving an LCD panel. The drive voltage generator circuit is composed of a breeder, a buffer amplifier, a switch circuitry, and a set of first to N-th output terminals on which the drive voltages are developed, respectively. The breeder develops a set of first to N-th different voltages on first to N-th nodes, respectively, N being any integer equal to or more than 2, and the first to N-th voltages being associated with grayscale levels, respectively. The switch circuitry switches connections among an input and an output of the buffer amplifier, the first to N-th nodes, and the first to N-th output terminals.

This architecture of the drive voltage generator circuit only requires one buffer amplifier for developing N drive voltages associated with N different grayscale levels, and therefore effectively reduces the number of buffer amplifiers for driving the LCD panel. This effectively reduces the power consumption and circuit size of the LCD driver.

DESCRIPTION OF THE PREFERRED EMBODIMENTS

Preferred embodiments of the present invention will be described in detail with reference to the attached drawings. It should be noted that same numerals denote same, or like components in the attached drawings.

First Embodiment (System Structure)

Figure 4:
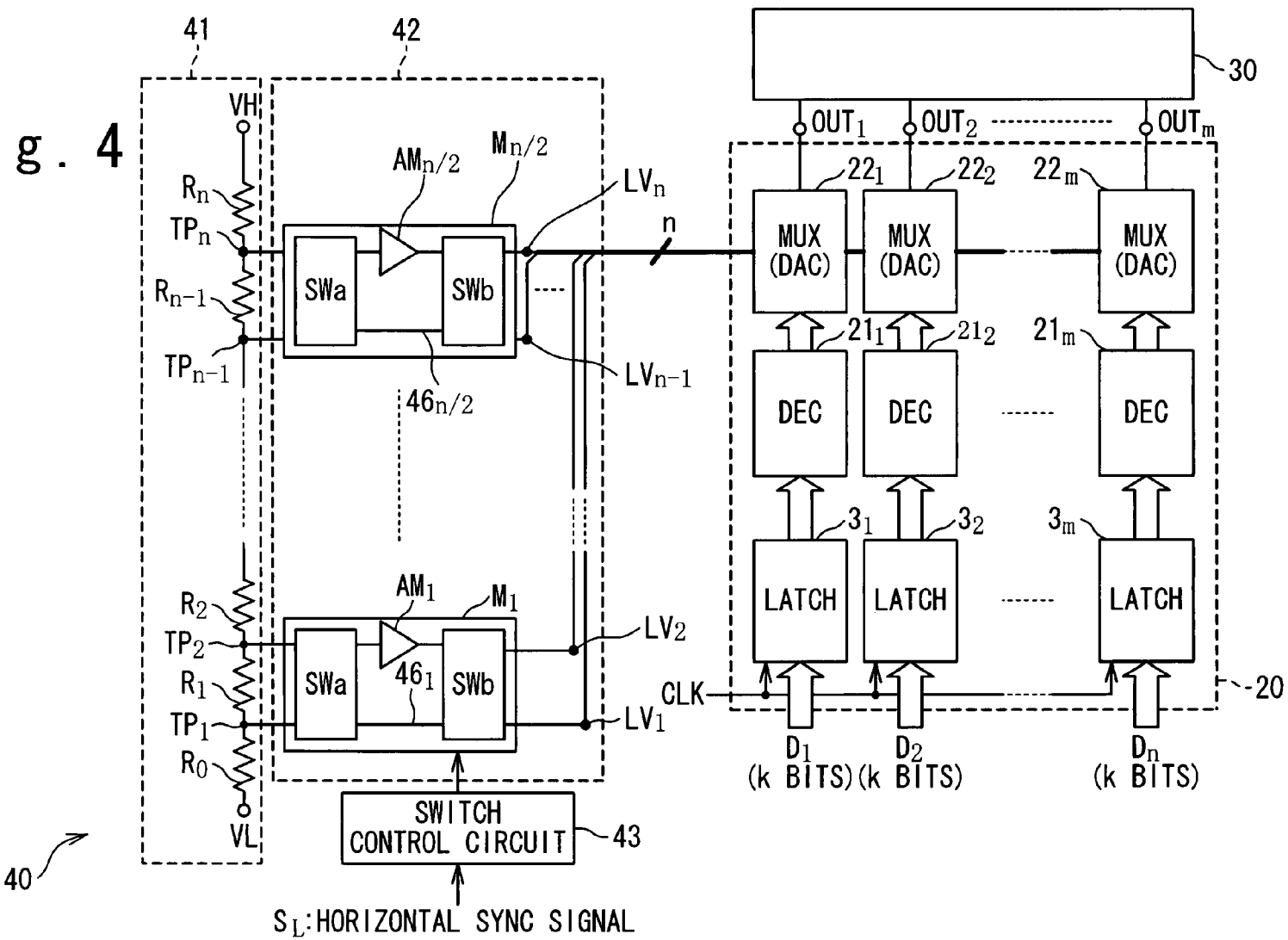
FIG. 4 is a block diagram illustrating an exemplary structure of an LCD driver in a first embodiment.

In a first embodiment, as illustrated in FIG. 4, a liquid crystal display apparatus is composed of an LCD panel 30, and an LCD driver including a drive voltage generator circuit 40 and a driver circuitry 20. The driver circuitry 20 is connected to the drive voltage generator circuit 40 and also to the LCD panel 30.

The drive voltage generator circuit 40 is composed of a breeder (voltage generator) 41, and a buffer circuitry 42, and a switch control circuit 43.

The breeder 41 is comprised of a set of resistor elements $R_0$ to $R_n$ serially connected between the power supply $V_H$ and ground $V_L$ to generate n different voltages associated with grayscale levels; n being the number of available grayscale levels, equal to $2^k$, where the k is the number of data bits of each pixel data. The resistor element $R_j$ is connected to the adjacent resistor element $R_{j-1}$ with a node $TP_j$ disposed therebetween, and the resistor element $R_{j-1}$ is connected to the adjacent resistor element $R_{j-2}$ with a node $TP_{j-1}$, where j is any even number equal to or less than n. Such connection provides different voltages on the nodes $TP_1$ to $TP_n$; the voltages developed on the nodes $TP_1$ to $TP_n$ are denoted by numerals $V_1$ to $V_n$, respectively. It should be noted that the voltages $V_1$ to $V_n$ satisfy the following relation:

$$V_1<V_2<\ldots<V_n.$$

The buffer circuitry 42 is composed of a set of n/2 buffer modules $M_1$ to $M_{n/2}$, each including an input switch module SWa, an output switch module SWb, and a buffer amplifier; the buffer amplifier within the buffer module $M_{j/2}$ is denoted by numeral $AM_{j/2}$, hereinafter. Inputs of the input switch module SWa of the buffer module $M_{j/2}$ are connected to the nodes $TP_j$ and $TP_{j-1}$. An output of the input switch module SWa of the buffer module $M_{j/2}$ is connected to an input of the buffer amplifier $AM_{j/2}$. An output of the buffer amplifier $AM_{j/2}$ is connected to an input of the output switch module SWb. Another input of the output switch module SWb is connected to the node $TP_{j-1}$ through a bypass line $\mathbf{46}_{j/2}$ and the input switch module SWa. Outputs of the output switch module SWb within the buffer amplifier $AM_{j/2}$ are connected to output terminals $LV_j$ and $LV_{j-1}$ of the buffer circuitry 42. The output terminals $LV_1$ to $LV_n$ are connected to the drive circuitry 20 through a set of n signal lines.

The switch control circuit 43 is responsive to an externally inputted horizontal sync signal $S_L$ for providing a switch control signal for each of the input and output switch modules SWa and SWb within each buffer module. The horizontal sync signal $S_L$ is indicative of the beginning of each horizontal period; the horizontal sync signal $S_L$ is activated at the beginning of each horizontal period. The duration of each horizontal period is referred to as 1H, hereinafter. The input switch module SWa within the buffer module $M_{j/2}$ switches connections among the nodes $TP_j$, $TP_{j-1}$, and the input of the buffer amplifier $AM_{j/2}$ in response to the associated switch control signal received from the switch control circuit 43. The buffer amplifier $AM_{j/2}$ provide buffering for the output of the input switch module SWa within the buffer module $M_{j/2}$. The output switch module SWb within the buffer module $M_{j/2}$ switches connections among the output terminals $LV_j$, $LV_{j-1}$, the bypass line $\mathbf{46}_{j/2}$, and the output of the buffer amplifier $AM_{j/2}$, in response to the associated switch control signal received from the switch control circuit 43.

Figure 1:
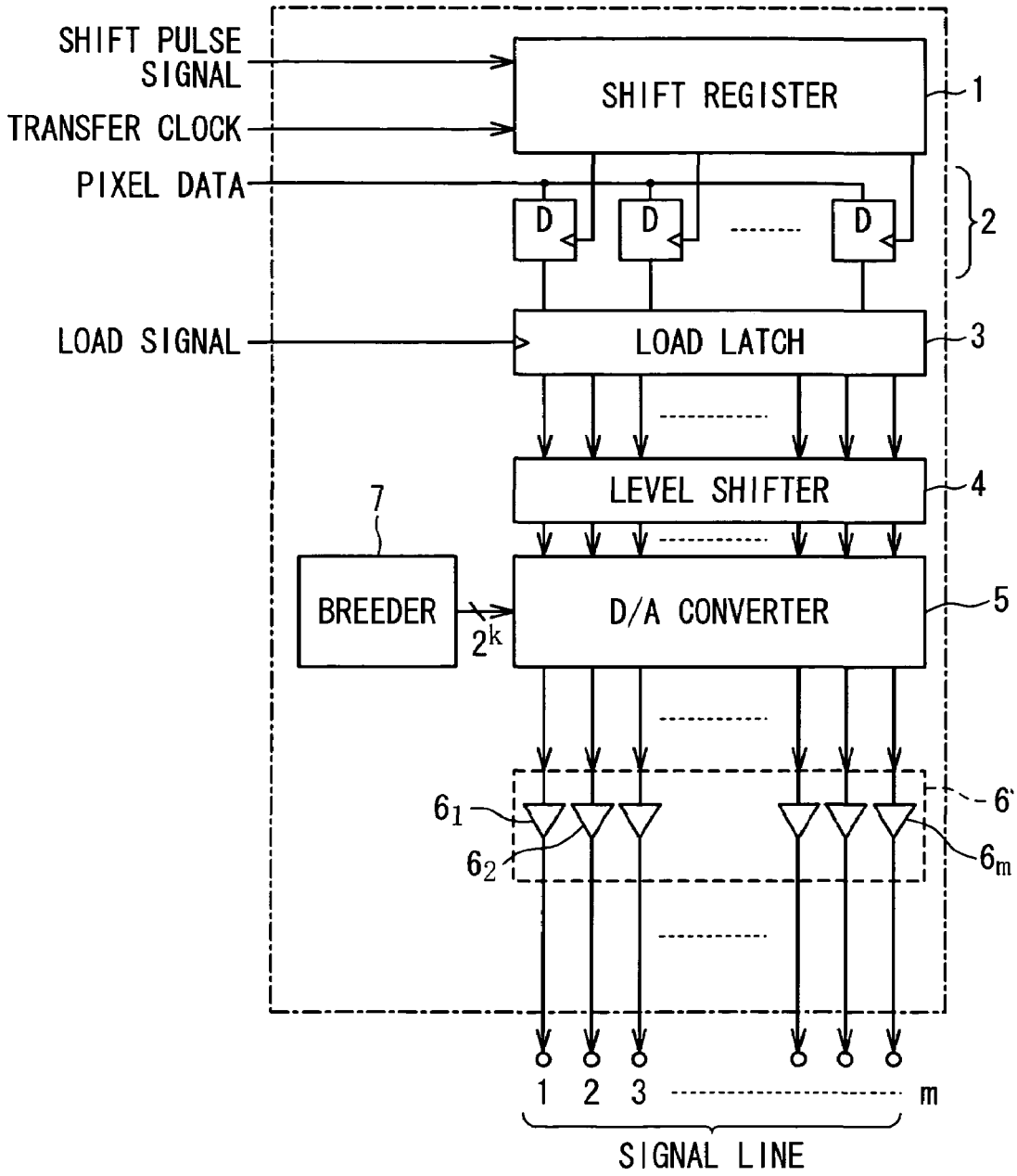
Fig. 1 PRIOR ART
FIG. 1 is a block diagram illustrating a conventional LCD driver structure.
Figure 2:
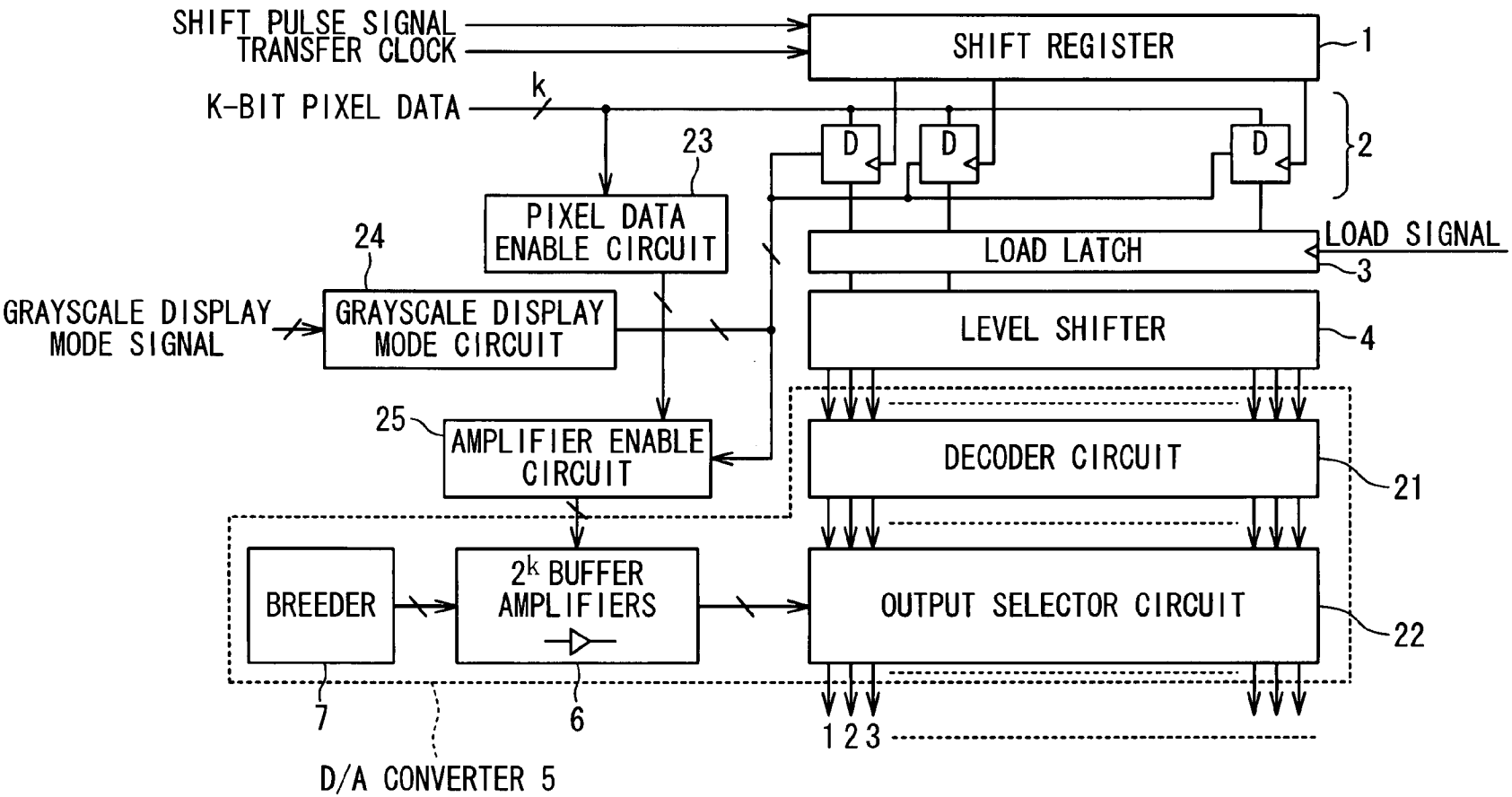
Fig. 2 PRIOR ART
FIG. 2 is a block diagram illustrating another conventional LCD driver structure.
Figure 3:
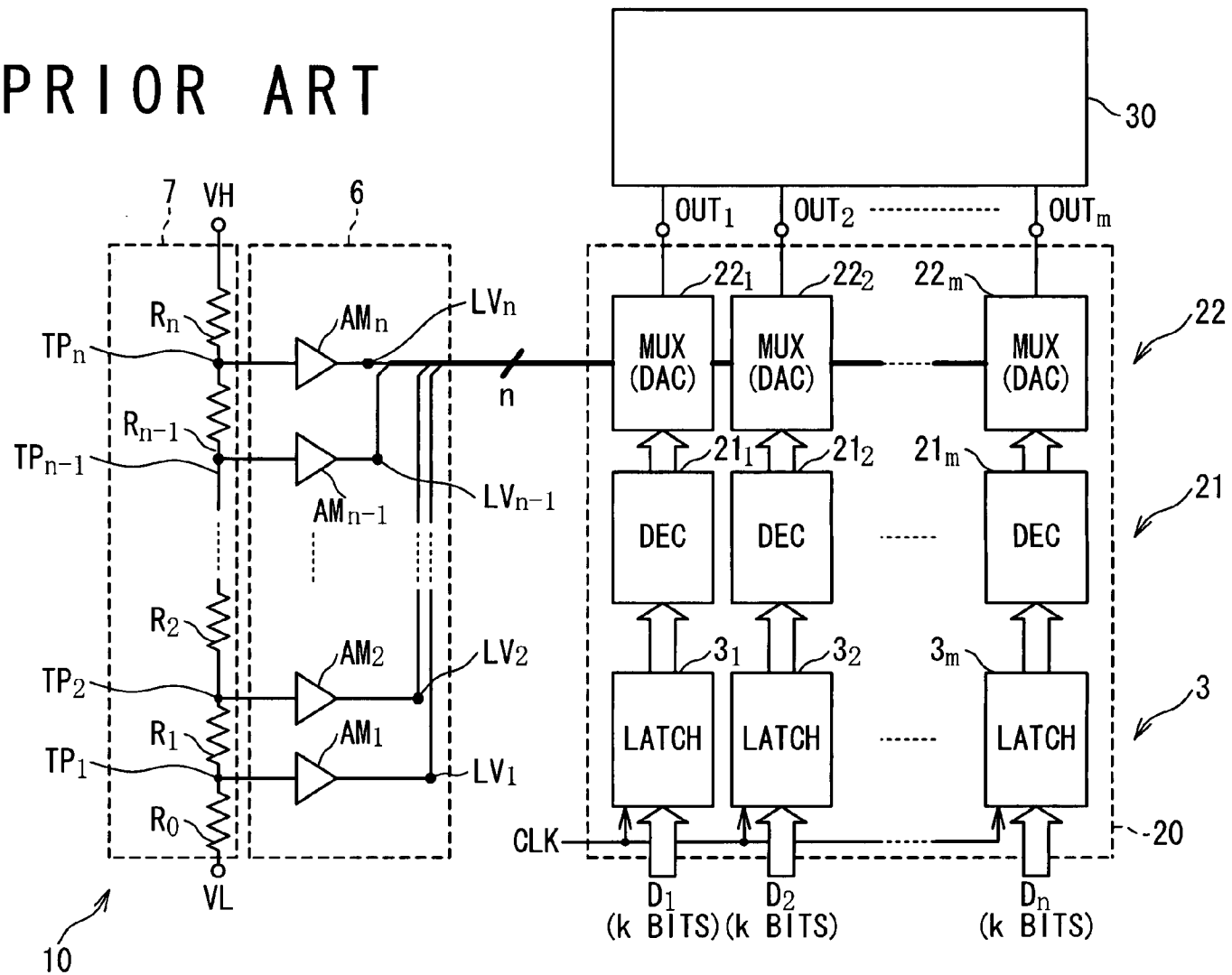
Fig. 3 PRIOR ART
FIG. 3 is a detailed block diagram illustrating the conventional LCD driver structure shown in FIG. 2.

The structure of the drive circuitry 20, on the other hand, is similar to that shown in FIG. 3. Specifically, the drive circuitry 20 is composed of a set of m latches $\mathbf{3}_1$ to $\mathbf{3}_m$, a set of m decoders $\mathbf{21}_1$ to $\mathbf{21}_m$, and a set of multiplexers $\mathbf{22}_1$ to $\mathbf{22}_m$ that functions as D/A converters. The outputs of the latches $\mathbf{3}_1$ to $\mathbf{3}_m$ are connected to the inputs of the decoders $\mathbf{21}_1$ to $\mathbf{21}_m$, respectively. The outputs of the decoders $\mathbf{21}_1$ to $\mathbf{21}_m$ are connected to the select inputs of the multiplexers $\mathbf{22}_1$ to $\mathbf{22}_m$, respectively. The outputs of the multiplexers $\mathbf{22}_1$ to $\mathbf{22}_m$ are connected to the output terminals of the LCD driver, which are denoted by symbols $OUT_1$ to $OUT_m$, respectively. The output terminals $OUT_1$ to $OUT_m$ are connected to the signal lines of the LCD panel 30. The latches $\mathbf{3}_1$ to $\mathbf{3}_m$ latch externally inputted k-bit pixel data $D_1$ to $D_m$, respectively, in synchronization with an externally inputted transfer clock CLK. The clock CLK is synchronous with the horizontal sync signal $S_L$. The latched k-bit pixel data $D_1$ to $D_m$ are provided for the decoders $\mathbf{21}_1$ to $\mathbf{22}_m$. The decoders $\mathbf{21}_1$ to $\mathbf{22}_m$ decode the pixel data $D_1$ to $D_m$.

The multiplexers $\mathbf{22}_1$ to $\mathbf{22}_m$ are each designed to select among the voltages $V_1$ to $V_n$ developed on the output terminals $LV_1$ to $LV_n$ in response to the decoded pixel data $D_1$ to $D_m$, respectively. When a pixel data $D_v$ is "111111" with k=6, v being a natural number ranging from 1 to n, for example, the multiplexer $\mathbf{22}_v$ selects the voltage $V_n$ out of the voltages $V_1$ to $V_n$. When a pixel data $D_v$ is "000000", on the other hand, the multiplexer $\mathbf{22}_v$ selects the voltage $V_1$ out of the voltages $V_1$ to $V_n$. The multiplexers $\mathbf{22}_1$ to $\mathbf{22}_m$ provide the selected voltages for the LCD panel 30 through the associated output terminals $OUT_1$ to $OUT_m$, respectively.

(Arrangement and Operation of Buffer Modules)

Figure 5A:
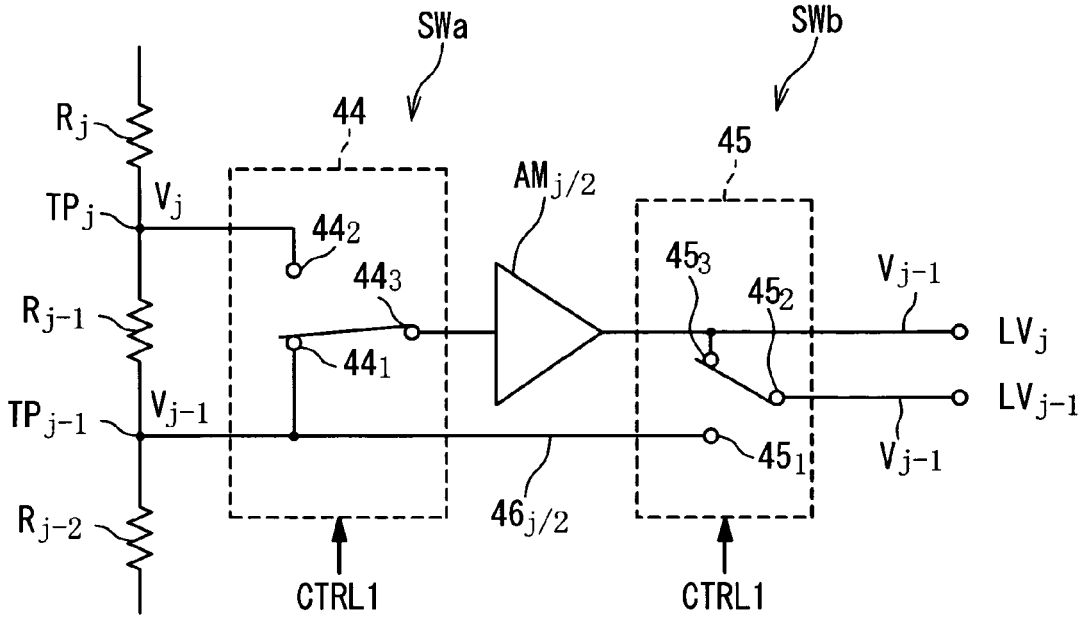
FIGS. 5A and 5B are circuit diagrams illustrating an exemplary structure and operation of a buffer circuitry disposed within the LCD driver in the first embodiment.
Figure 5B:
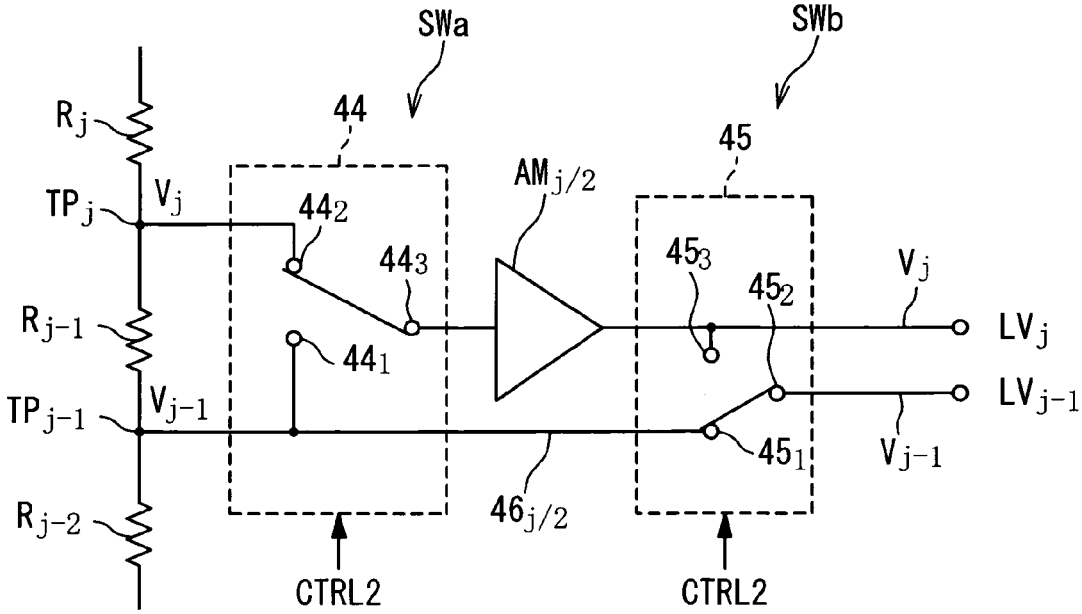

FIGS. 5A and 5B illustrate an exemplary arrangement of the buffer modules $M_1$ to $M_{n/2}$.

The input switch module SWa within the buffer module $M_{j/2}$ is composed of a switch 44 having first to third terminals $\mathbf{44}_1$ to $\mathbf{44}_3$. The first terminal $\mathbf{44}_1$ receives the voltage $V_{j-1}$ from the node $TP_{j-1}$, while the second terminal $\mathbf{44}_2$ receives the voltage $V_j$ from the node $TP_j$. The third terminal $\mathbf{44}_3$ is connected to the input of the buffer amplifier $AM_{j/2}$. The switch 44 connects selected one of the first and second terminals $\mathbf{44}_1$ and $\mathbf{44}_2$ to the third terminal $\mathbf{44}_3$.

The output switch module SWb, on the other hand, has a switch 45 having first to third terminals $\mathbf{45}_1$ to $\mathbf{45}_3$. The first terminal $\mathbf{45}_1$ is connected to the node $TP_{j-1}$ through the bypass line $\mathbf{46}_{j/2}$, and directly receives the voltage $V_{j-1}$ from the node $TP_{j-1}$. The second terminal $\mathbf{45}_2$ is connected to the output terminal $LV_{j-1}$. The third terminal $\mathbf{45}_3$ is connected to the output of the buffer amplifier $AM_{j/2}$. The output of the buffer amplifier $AM_{j/2}$ is also directly connected to the output terminal $LV_j$.

One feature of this arrangement is that the buffer module $M_{j/2}$ uses the buffer amplifier $AM_{j/2}$ for driving both of the output terminals $LV_j$ and $LV_{j-1}$. Using one buffer amplifier for driving multiple output terminals of the drive voltage generator circuit 40 effectively reduces the number of the buffer amplifiers within the LCD driver.

Another feature is that the buffer module $M_{j/2}$ provides step-by-step driving for the output terminal that is latterly driven. This effectively suppress over-shoot of the voltage on the output terminal $LV_j$.

Figure 6:
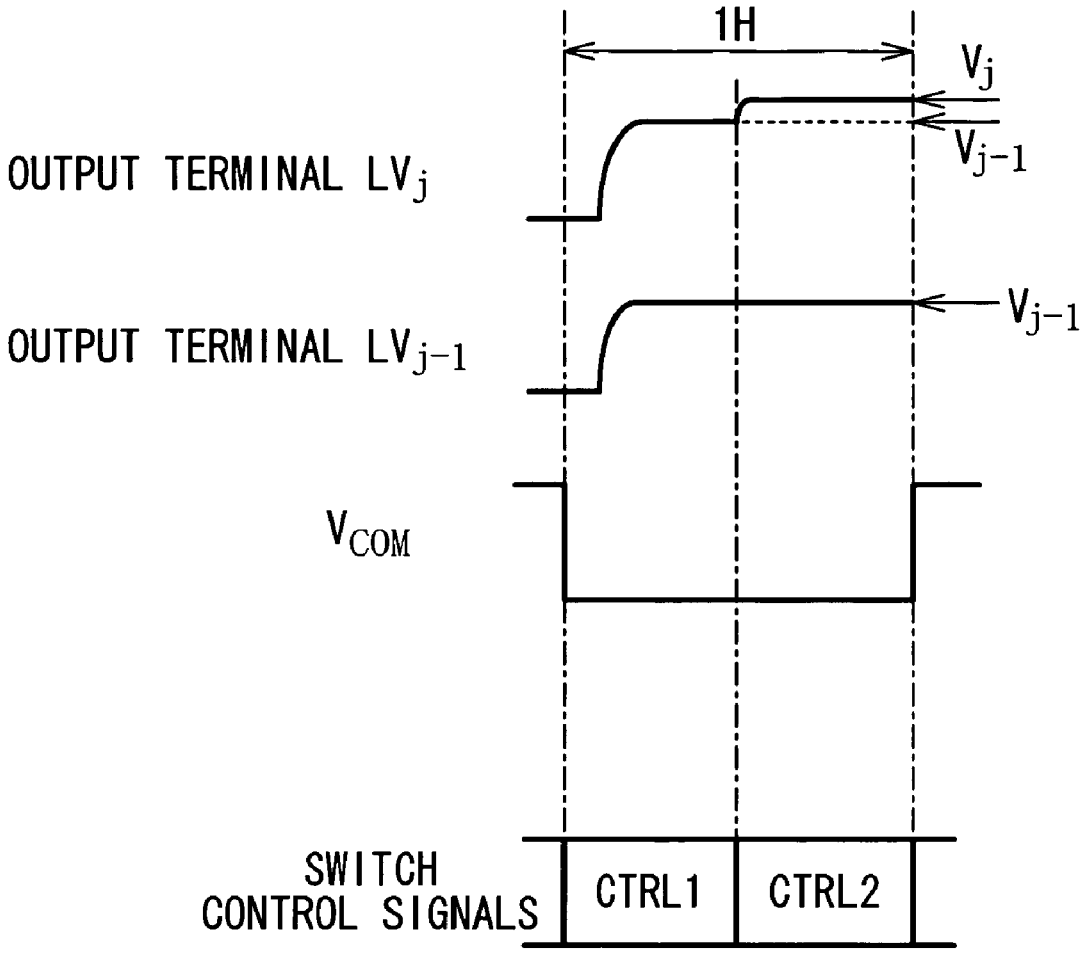
FIG. 6 is a timing chart illustrating the operation of the buffer circuitry in the first embodiment.

More specifically, the buffer module $M_{j/2}$ functions as follows. FIG. 6 is a timing chart illustrating an exemplary operation of the buffer module $M_{j/2}$ and the switch control circuit 43.

When a horizontal period is initiated, as shown in FIG. 6, the horizontal sync signal $S_L$ is activated, and the voltage on the common electrode of the LCD panel 30 (referred to as the common voltage $V_{COM}$, hereinafter) is switched; the common voltage $V_{COM}$ is pull down to ground in this operation.

In response to the activation of the horizontal sync signal $S_L$, the switch control circuit 43 switches the switch control signals provided for the input and output switch modules SWa and SWb within the buffer module $M_{j/2}$ to a first state, referred to as the state "CTRL1", at the beginning of the first half of the horizontal period.

In response to the associated switch control signal being placed into the state "CTRL1", as shown in FIG. 5A, the switch 44 within the input switch module SWa connects the first terminal $44_1$ with the third terminal $44_3$, and thereby provides a connection between the node $TP_{j-1}$ and the input of the buffer amplifier $AM_{j/2}$.

Additionally, the switch 45 within the output switch module SWb connects the second terminal $45_2$ with the third terminal $45_3$ in response to the associated switch control signal being placed into the state "CTRL1". In other words, the output switch module SWb provides a connection between the output of the buffer amplifier $AM_{j/2}$ and the output terminal $LV_{j-1}$.

As shown in FIG. 6, this results in that both of the output terminals $LV_{j-1}$ and $LV_j$ are driven to the voltage $V_{j-1}$ by the buffer amplifier $AM_{j/2}$, during the first half of the horizontal period.

The switch control circuit 43 then switches the switch control signals to a second state, referred to as the state "CTRL2", at the beginning of the latter half of the horizontal period.

In response to the associated switch control signal being switched to the state "CTRL2", as shown in FIG. 5B, the switch 44 within the input switch module SWa connects the second terminal $44_2$ with the third terminal $44_3$, and thereby provides a connection between the node $TP_j$ and the input of the buffer amplifier $AM_{j/2}$.

Additionally, the switch 45 within the output switch module SWb connects the second terminal $45_2$ with the first terminal $45_1$ in place of the third terminal $45_3$, in response to the associated switch control signal being placed into the state "CTRL2". In other words, the output switch module SWb provides a connection between the output terminal $LV_{j-1}$ and the node $TP_{j-1}$ through the bypass line $46_{j/2}$, disconnecting the output of the buffer amplifier $AM_{j/2}$ from the output terminal $LV_{j-1}$.

As shown in FIG. 6, this results in that the output terminal $LV_j$ is pulled up to the voltage $V_j$ from the voltage $V_{j-1}$ during the latter half of the horizontal period, while the voltage developed on the output terminal $LV_{j-1}$ is maintained at the voltage $V_{j-1}$ through connecting the output terminal $LV_{j-1}$ to the node $TP_{j-1}$ through the bypass line $46_{j/2}$.

It should be noted that driving the output terminals $LV_1$ to $LV_n$ to the voltages $V_1$ to $V_n$ is only required to be complete by the end of the horizontal period. Although the step-by-step driving may cause a specific signal line to be driven to an undesirable voltage at the middle of the horizontal period, it does not affect the grayscale level finally represented on the pixels of the LCD panel 30 at the end of the horizontal period, because the aforementioned step-by-step driving allows the multiplexers $21_1$ to $21_m$ to receive the voltages $V_1$ to $V_n$ as required at the end of the horizontal period, and to develop the desired voltages on the respective signal lines.

The order in which the voltages $V_j$ and $V_{j-1}$ are developed on the outputs terminals $LV_j$ and $LV_{j-1}$ is preferably dependent on the level of the common voltage $V_{COM}$, developed on the common electrode of the LCD panel 30. As described above, for a horizontal period during which the common voltage $V_{COM}$ is pulled down to ground, the input switch module SWa selects the voltage $V_{j-1}$ to output to the input of the buffer amplifier $AM_{j/2}$ during the first half of the horizontal period, and then selects the voltage $V_j$ during the latter half of the horizontal period.

For a horizontal period during which the common voltage $V_{COM}$ is pulled up to a power supply voltage, higher than the voltage $V_n$, the order in which the voltages $V_j$ and $V_{j-1}$ are selected by the input switch module SWa is reversed.

Specifically, the input switch module SWa selects the voltage $V_j$ during the first half of the horizontal period, while the output switch module SWb provides connections between the output of the buffer amplifier $AM_{j/2}$ and both of the output terminals $LV_{j-1}$ and $LV_j$. This results in that both of the output terminals $LV_{j-1}$ and $LV_j$ are driven to the voltage $V_j$.

During the latter half of the horizontal period, the input switch module SWa selects the voltage $V_{j-1}$, while the output switch module SWb provides a connection between only the output terminal $LV_{j-1}$ and the output of the buffer amplifier $AM_{j/2}$; the output terminal $LV_j$ is disconnected from the output of the buffer amplifier $AM_{j/2}$, and directly connected to the node $TP_j$ through an additional bypass line. This results in that the output terminals $LV_{j-1}$ is driven to the voltage $V_{j-1}$ with the output terminal $LV_j$ maintained at the voltage $V_j$.

In summary, the LCD driver architecture in this embodiment effectively reduces the power consumption and circuit size through reducing the number of necessary buffer amplifiers. Although the architecture in this embodiment additionally incorporates the set of input and output switch modules SWa and SWb, the input and output switch modules SWa and SWb can be implemented with reduced hardware implementations due to the simplicity.

Additionally, the LCD driver architecture in this embodiment effectively avoids over-shoot of the voltages on the output terminals of the drive voltage generator circuit 40 through adopting step-by-step driving.

Figure 13:
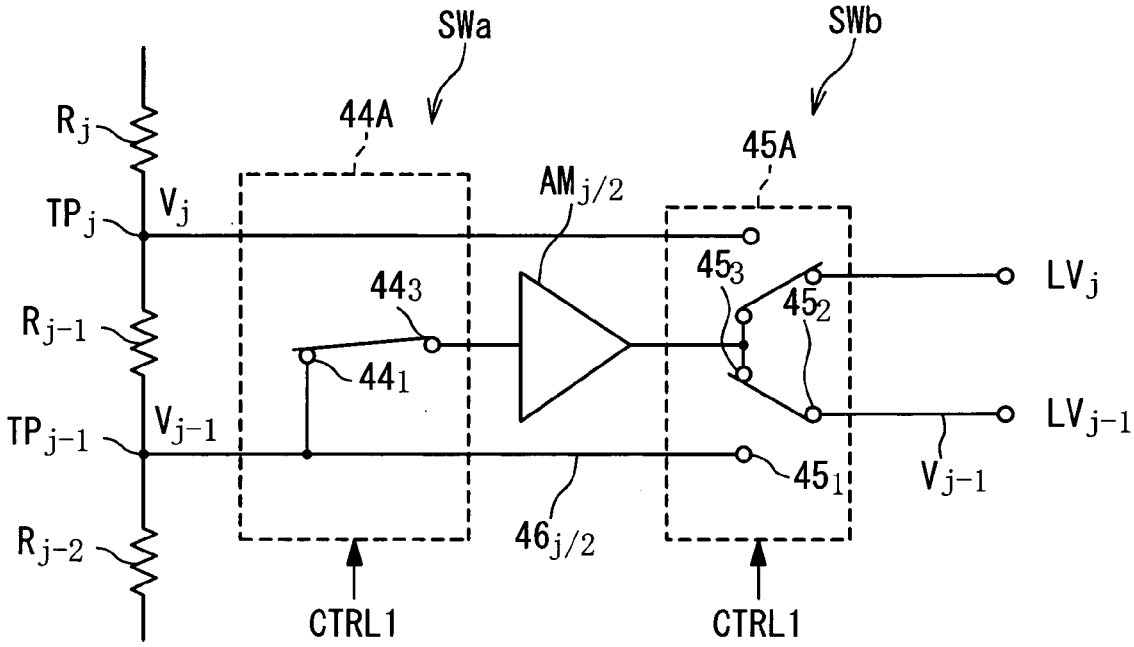
FIG. 13 is a circuit diagram illustrating a preferred structure of the buffer circuitry in the first embodiment.

In an alternative embodiment, the structure of the input and output switch modules SWa and SWb of the buffer module $M_{j/2}$ may be modified as shown in FIG. 13. In the structure shown in FIG. 13, the input switch module SWa within the buffer module $M_{j/2}$ is composed of a switch 44A that is responsive to the control signal received from the switch control circuit 43 for providing an electrical connection between the node $TP_{j-1}$ and the input of the buffer amplifier $AM_{j/2}$. The output switch module SWb is composed of a switch 45A that is responsive to the control signal received from the switch control circuit 43 for providing electrical connections among the nodes $TP_{j-1}$, and $TP_j$, the output of the buffer amplifier $AM_{j/2}$, and the output terminals $LV_j$ and $LV_{j-1}$. The switch 45A is designed to electrically connect selected one of the nodes $TP_{j-1}$ and the output of the buffer amplifier $AM_{j/2}$ to the output terminal $LV_{j-1}$, and also to electrically connect selected one of the nodes $TP_j$ and the output of the buffer amplifier $AM_{j/2}$ to the output terminal $LV_j$.

The buffer module $M_{j/2}$ of FIG. 13 operates as follows. The operation of the buffer module $M_{j/2}$ of FIG. 13 divides each horizontal period into first and second periods; the first period begins at the beginning of each horizontal period, and the second period follows the first period. During the first period, the switch 44A within the input switch module SWa establish an electrical connection between the node $TP_{j-1}$ to the input of the buffer amplifier $AM_{j/2}$, and the output switch module SWb establishes electrical connections between the output of the buffer amplifier $AM_{j/2}$ and the output terminals $LV_{j-1}$ and $LV_j$. This results in that both of the output terminals $LV_{j-1}$ and $LV_j$ are driven to the voltage $V_{j-1}$ by the buffer amplifier $AM_{j/2}$, during the first period.

During the second period, the switch 44A disconnects the node $TV_{j-1}$ from the input of the buffer amplifier $AM_{j/2}$, and the switch 54A establishes an electrical connection between the node $TV_{j-1}$ and the output terminal $LV_{j-1}$, and also establishes another electrical connection between the node $TV_j$ and the output terminal $LV_j$; the output of the buffer amplifier $AM_{j/2}$ is disconnected from both of the output terminals $LV_{j-1}$ and $LV_j$ This results in that the output terminal $LV_j$ is driven to the voltage $V_j$ with the output terminal $LV_{j-1}$ maintained at the voltage $V_{j-1}$.

This operation advantageously achieves further reduction in the power consumption. The aforementioned operation allows the buffer amplifier $AM_{j/2}$ to be disenabled during the second period. This effectively reduces the power consumption of the buffer module $M_{j/2}$.

It is preferable that the duration of the second period, during which the buffer amplifier $AM_{j/2}$ is disconnected from both of the output terminals $LV_{j-1}$ and $LV_j$, is longer than that of the first period. This is because driving the output terminal $LV_j$ to the voltage $V_j$ without using the buffer amplifier $AM_{j/2}$ requires longer duration compared to the duration necessary for driving the output terminals $LV_{j-1}$ and $LV_j$ using the buffer amplifier $AM_{j/2}$. In an exemplary operation, the duration of the first period is one-fifth of that of the horizontal period, while the duration of the second period is four-fifth of that of the horizontal period.

Second Embodiment

Figure 7:
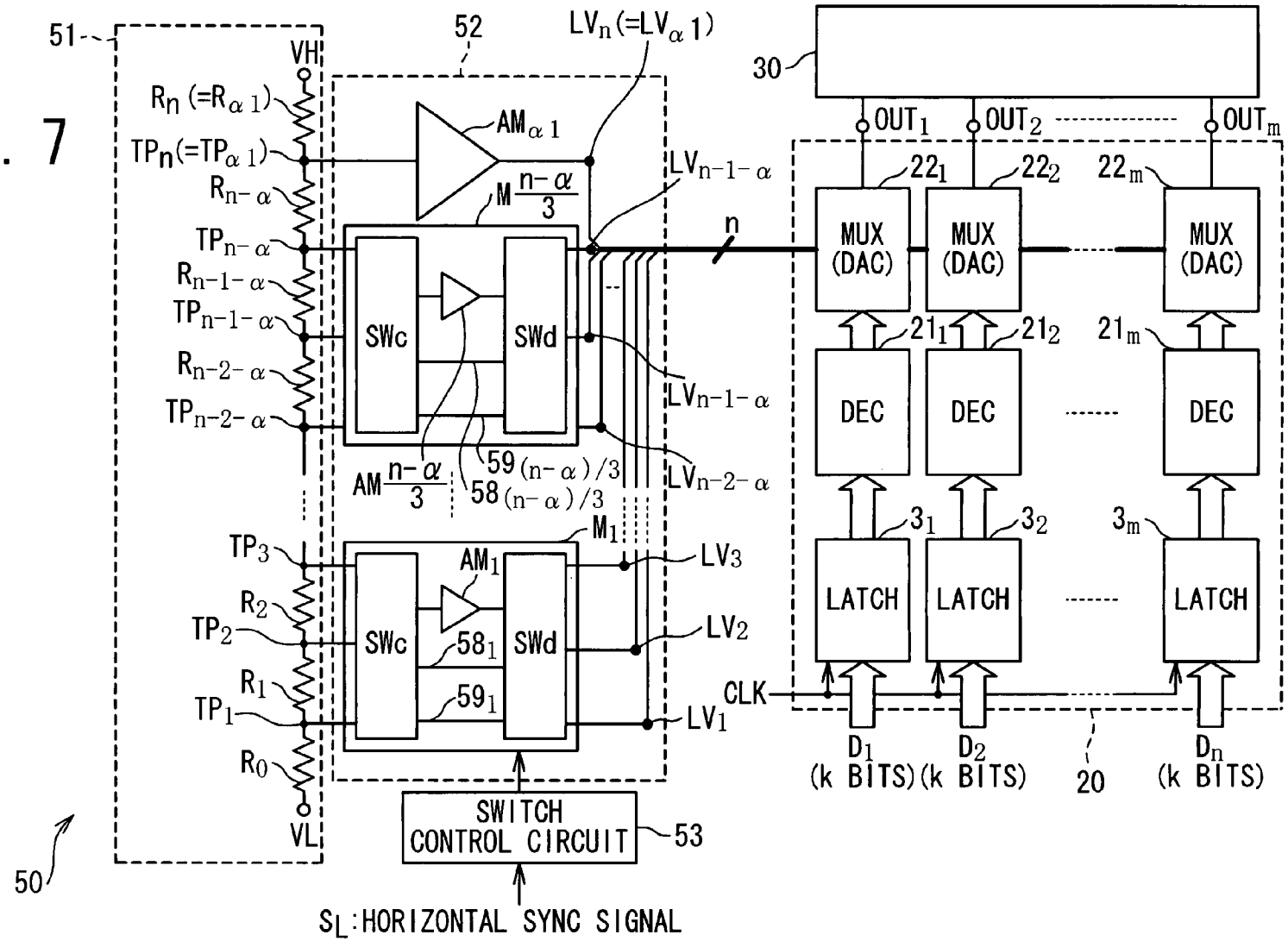
FIG. 7 is a block diagram illustrating an exemplary structure of an LCD driver in a second embodiment.

FIG. 7 illustrates an exemplary structure of a liquid crystal display apparatus in a second embodiment. The structure liquid crystal display apparatus in the second embodiment is similar to that in the first embodiment, except for that the arrangement of the drive voltage generator circuit, denoted by numeral 50. The major difference is that the drive voltage generator circuit 50 uses one buffer amplifier for driving each three output terminals. A detailed description of an exemplary structure and operation of the drive voltage generator circuit 50 is given in the following.

The drive voltage generator circuit 50 is composed of a breeder 51, a buffer circuitry 52, and a switch control circuit 53.

The breeder 51 is comprised of a set of serially connected resistors $R_0$ to $R_n$ between the power supply $V_H$ and ground $V_L$ to generate n different voltages associated with grayscale levels; n being the number of available grayscale levels, equal to $2^k$, where the k is the number of data bits of each pixel data. The resistor element $R_w$ is connected to the adjacent resistor element $R_w$_with a node $TP_w$ disposed therebetween, where w is any integer ranging from 1 to n. Such connection provides different voltages $V_1$ to $V_n$ on the nodes $TP_1$ to $TP_n$. It should be noted that the voltages $V_1$ to $V_n$ satisfy the following relation:

ti $V_1<V_2< \ldots <V_n$.

The buffer circuitry 52 is composed of $(n-\alpha)/3$ buffer modules $M_1$ to $M_{(n-\alpha)/3}$, and one or two additional buffer amplifiers having a gain of 1; $\alpha$ is the remainder obtained by dividing n by 3. The number of the additional buffer amplifier(s) is identical to the remainder $\alpha$. In this embodiment, one buffer amplifier $AM_{\alpha 1}$ is provided for the buffer circuitry 52 with n=64, and $\alpha$=1.

The input of the buffer amplifier $AM_{\alpha 1}$ is connected to the node $TP_n$, and the output of the buffer amplifier $AM_{\alpha 1}$ is connected to the output terminal $LV_n$. The buffer amplifier $AM_{\alpha 1}$ provides buffering for the voltage $V_n$ received from the node $TP_n$ to develop the voltage ideally identical to the voltage $V_n$ on the output terminal $LV_n$.

The buffer modules $M_1$ to $M_{(n-\alpha)/3}$ are each composed of an input switch module SWc, an output switch module SWd, and a buffer amplifier having a gain of 1; the buffer amplifier within the buffer module $M_{p/3}$ is denoted by numeral $AM_{p/3}$, hereinafter, where p is any multiple of 3 less than n, that is, p is any number selected out of 3, 6, . . . , n−α. Inputs of the input switch module SWc of the buffer module $M_{p/3}$ are connected to the nodes $TP_p$, $TP_{p-1}$ and $TP_{p-2}$. An output of the input switch module SWc is connected to an input of the buffer amplifier $AM_{p/3}$. An output of the buffer amplifier $AM_{p/3}$ is connected to an input of the output switch module SWd. Other two inputs of the output switch module SWd are connected to the nodes $TP_{p-1}$ and $TP_{p-2}$ through a pair of bypass lines $\mathbf{58}_{p/3}$, $\mathbf{59}_{p/3}$, and the input switch module SWc. Outputs of the output switch module SWd within the buffer amplifier $AM_{p/3}$ are connected to output terminals $LV_p$, $LV_{p-1}$, and $LV_{p-2}$ of the buffer circuitry 42. The output terminals $LV_1$ to $LV_n$ are connected to the drive circuitry 20 through a set of n signal lines.

The switch control circuit 53 is responsive to an externally inputted horizontal sync signal $S_L$ for providing a switch control signal for each of the input and output switch modules SWc and SWd within each buffer module. The input switch module SWc within the buffer module $M_{p/3}$ switches connections among the nodes $TP_p$, $TP_{p-1}$, $TP_{p-2}$, and the input of the buffer amplifier $AM_{p/3}$, in response to the associated switch control signal received from the switch control circuit 53. The buffer amplifier $AM_{p/3}$ provide buffering for the output of the input switch module SWc within the buffer module $M_{p/3}$. The output switch module SWd within the buffer module $M_{p/3}$ switches connections among the output terminals $LV_p$, $LV_{p-1}$, $LV_{p-2}$, the bypass lines $\mathbf{58}_{p/3}$, $\mathbf{59}_{p/3}$, and the output of the buffer amplifier $AM_{p/3}$, in response to the associated switch control signal received from the switch control circuit 53.

Figure 8A:
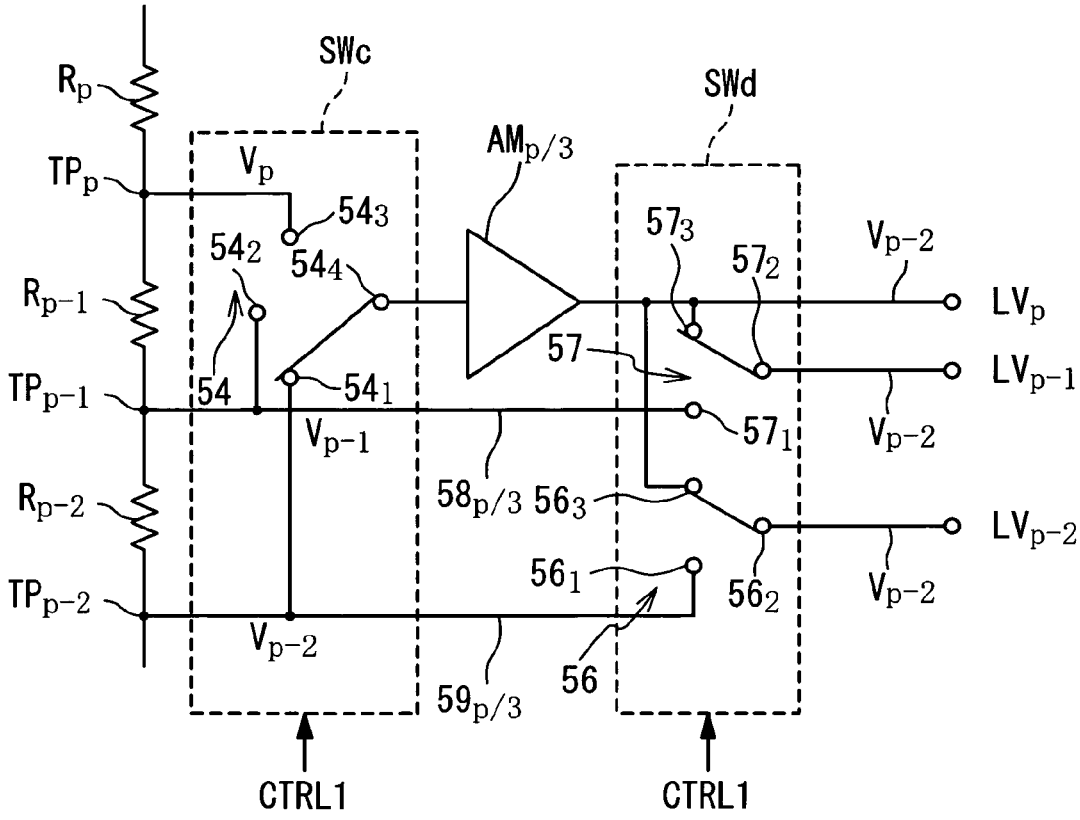
FIGS. 8A to 8C are circuit diagrams illustrating an exemplary structure and operation of a buffer circuitry disposed within the LCD driver in the second embodiment.
Figure 8B:
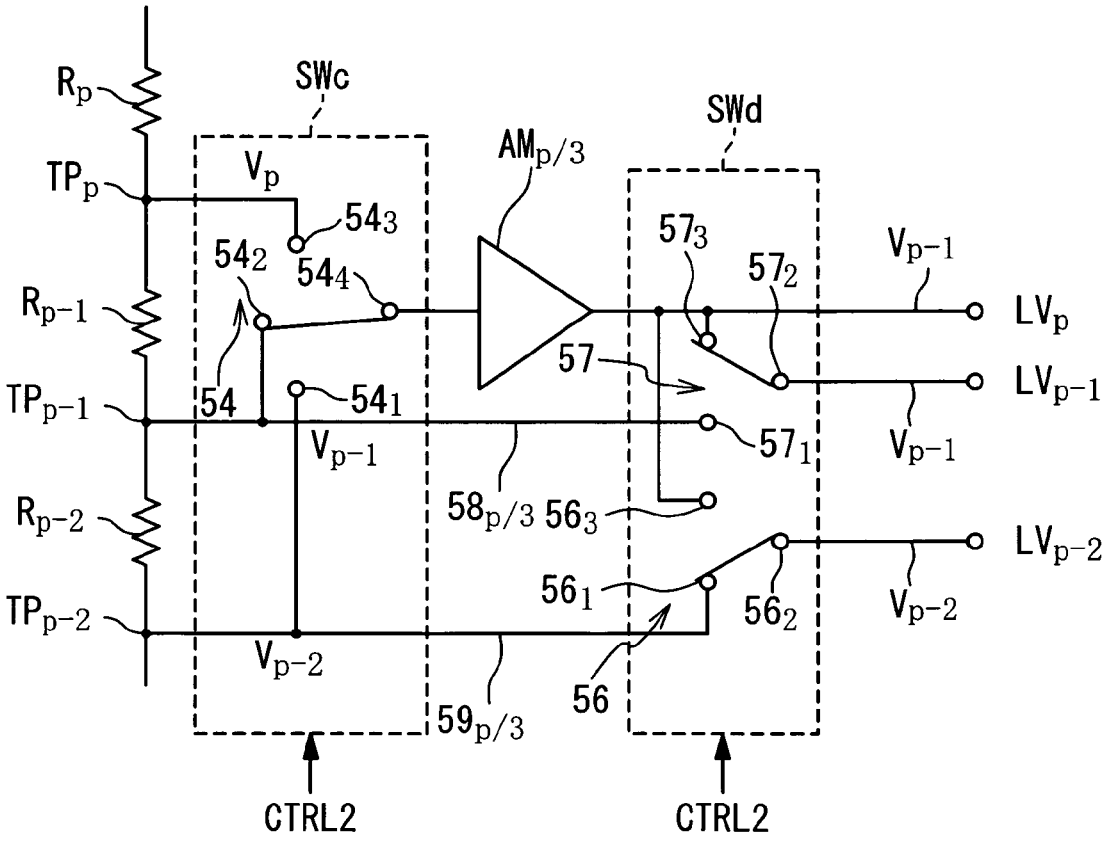
Figure 8C:
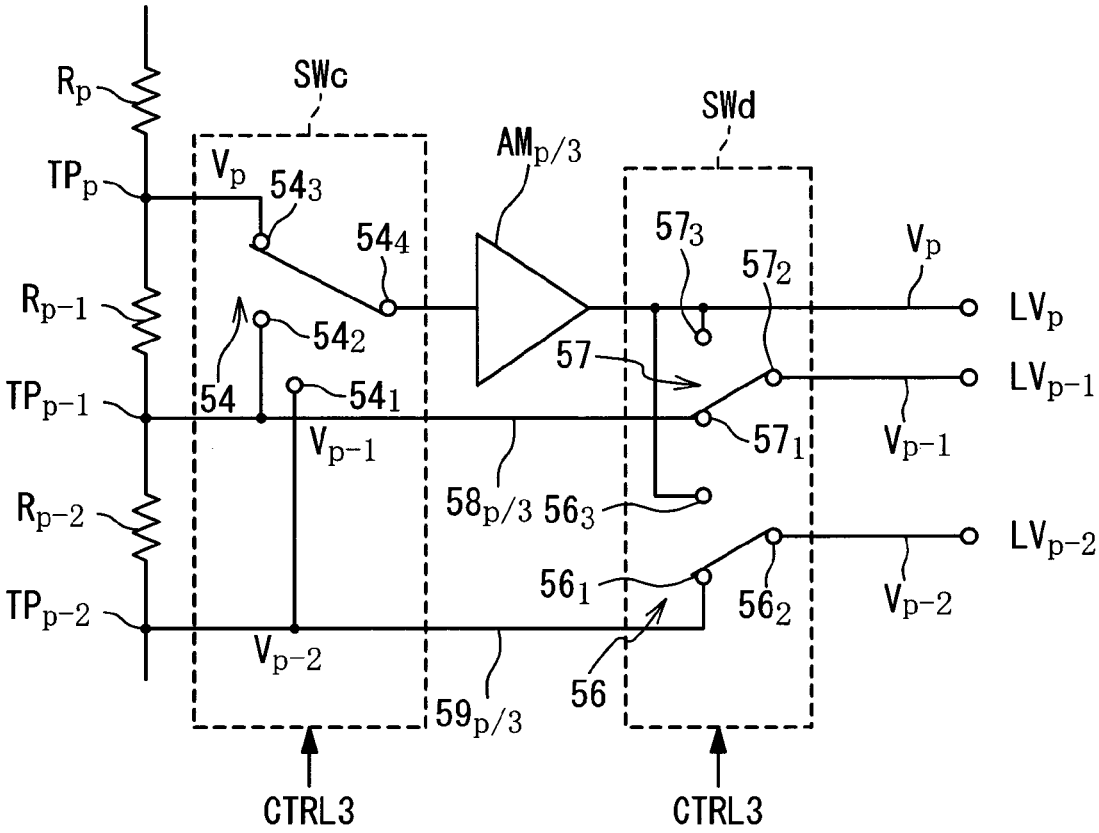

FIGS. 8A to 8C illustrate an exemplary structure of the buffer module $M_{p/3}$. The input switch module SWc within the buffer module $M_{p/3}$ is composed of a switch 54 having first to fourth terminals $\mathbf{54}_1$ to $\mathbf{54}_3$. The first terminal $\mathbf{54}_1$ receives the voltage $V_{p-2}$ from the node $TP_{p-2}$, and the second terminal $\mathbf{54}_2$ receives the voltage $V_{p-1}$ from the node $TP_{p-1}$. Furthermore, the third terminal $\mathbf{54}_3$ received the voltage $V_p$ from the node $TP_p$. The fourth terminal $\mathbf{54}_4$, on the other hand, is connected to the input of the buffer amplifier $AM_{p/3}$. The switch 54 connects selected one of the first to third terminals $\mathbf{54}_1$ and $\mathbf{54}_3$ to the fourth terminal $\mathbf{54}_4$.

The output switch module SWd, on the other hand, is composed of a pair of switches 56 and 57, each having three terminals; the switch 56 has first to third terminals $\mathbf{56}_1$ to $\mathbf{56}_3$, and the switch 57 has first to third terminals $\mathbf{57}_1$ to $\mathbf{57}_3$. The first terminal 56, of the switch 56 is connected to the node $TP_{p-2}$ through the bypass line $\mathbf{59}_{p/3}$, and directly receives the voltage $V_{p-2}$ from the node $TP_{p-2}$. The second terminal $\mathbf{56}_2$ is connected to the output terminal $LV_{p-2}$. The third terminal $\mathbf{56}_3$ is connected to the output of the buffer amplifier $AM_{p/3}$. The first terminal 57, of the switch 57, on the other hand, is connected to the node $TP_{p-1}$ through the bypass line $\mathbf{58}_{p/3}$, and directly receives the voltage $V_{p-1}$ from the node $TP_{p-1}$. The second terminal $\mathbf{57}_2$ is connected to the output terminal $LV_{p-1}$. The third terminal $\mathbf{57}_3$ is connected to the output of the buffer amplifier $AM_{p/3}$. The output of the buffer amplifier $AM_{p/3}$ is also directly connected to the output terminal $LV_p$.

Figure 9:
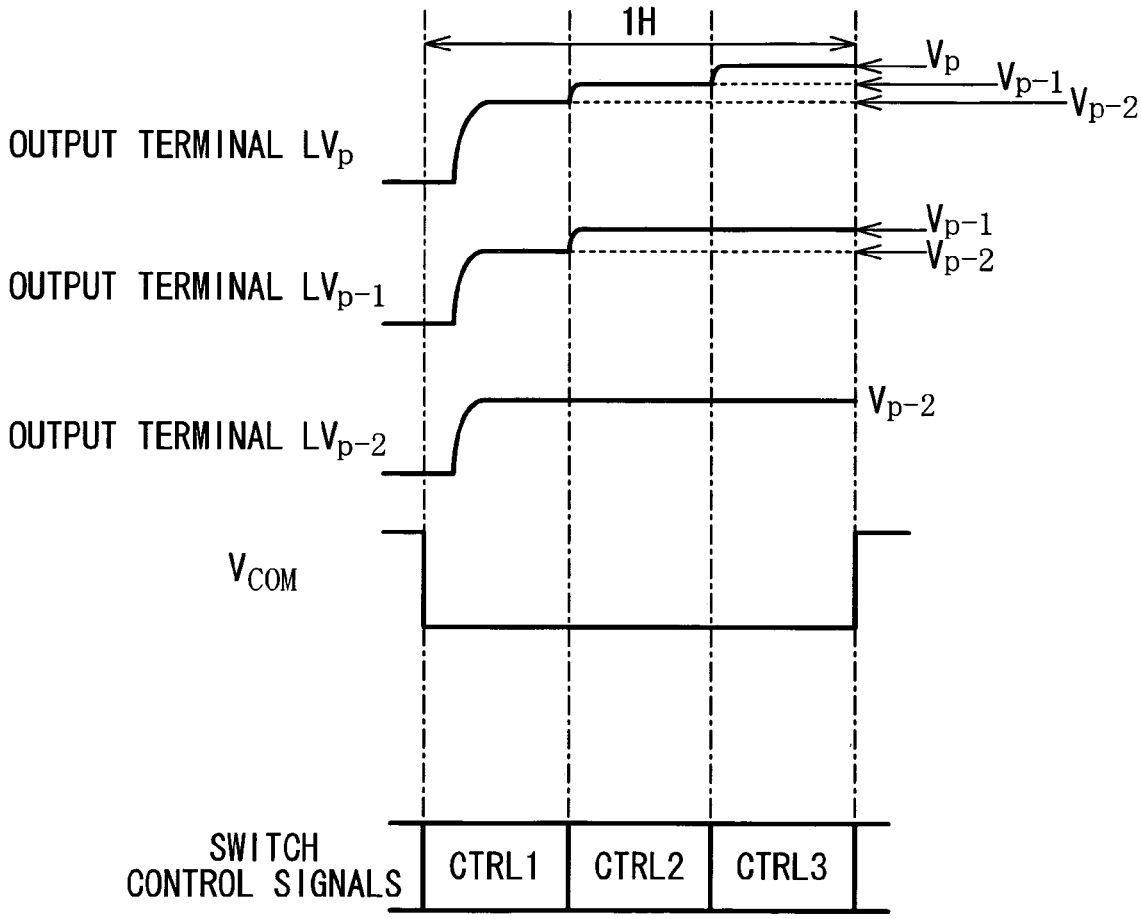
FIG. 9 is a timing chart illustrating the operation of the buffer circuitry in the first embodiment.

FIG. 9 is a timing chart illustrating an exemplary operation of the buffer module $M_{p/2}$ and the switch control circuit 53.

When a horizontal period is initiated, as shown in FIG. 9, the horizontal sync signal $S_L$ is activated, and the common voltage $V_{COM}$ is switched on the common electrode of the LCD panel; the common voltage $V_{COM}$ is pull down to ground in this operation.

In response to the activation of the horizontal sync signal $S_L$, the switch control circuit 53 switches the switch control signals provided for the input and output switch modules SWa and SWb within the buffer module $M_{p/3}$ to a first state, referred to as the state "CTRL1", at the beginning of the first one-third of the horizontal period.

In response to the associated switch control signal being placed into the state "CTRL1", as shown in FIG. 8A, the switch 54 within the input switch module SWc connects the first terminal $54_1$ with the fourth terminal $54_4$, and thereby provides a connection between the node $TP_{p-2}$ and the input of the buffer amplifier $AM_{p/3}$.

Additionally, the output switch module SWd connects the third terminal $56_3$ with the second terminal $56_2$ within the switch 56, and also connects the third terminal $57_3$ with the second terminal $57_2$ within the switch 57, in response to the associated switch control signal being placed into the state "CTRL1". In other words, the output switch module SWd provides connections from the output of the buffer amplifier $AM_{p/3}$ to the output terminals $LV_{p-2}$ and $LV_{p-1}$.

As shown in FIG. 9, this results in that all of the output terminals $LV_{p-2}$, $LV_{p-1}$, and $LV_p$ are driven to the voltage $V_{p-2}$ by the buffer amplifier $AM_{p/3}$, during the first one-third of the horizontal period.

The switch control circuit 53 then switches the switch control signals to a second state, referred to as the state "CTRL2", at the beginning of the second one-third of the horizontal period.

In response to the associated switch control signal being switched to the state "CTRL2", as shown in FIG. 8B, the switch 54 within the input switch module SWc connects the second terminal $54_2$ with the fourth terminal $54_4$, and thereby provides a connection between the node $TP_{p-1}$ and the input of the buffer amplifier $AM_{p/3}$.

Additionally, the output switch module SWb connects the second terminal $56_2$ with the first terminal $56_1$ in place of the third terminal $56_3$ within the switch 56, in response to the switch control signal being placed into the state "CTRL2". In other words, the output switch module SWb provides a connection between the output terminal $LV_{p-2}$ and the node $TP_{p-2}$ through the bypass line $59_{p/3}$, disconnecting the output of the buffer amplifier $AM_{p/3}$ from the output terminal $LV_{p-2}$.

As shown in FIG. 9, this results in that the output terminals $LV_{p-1}$ and $LV_p$ is pulled up to the voltage $V_{p-1}$ from the voltage $V_{p-2}$ while the voltage developed on the output terminal $LV_{p-2}$ is maintained at the voltage $V_{p-2}$ through connecting the output terminal $LV_{p-2}$ to the node $TP_{p-2}$ through the bypass line $59_{p/3}$.

The switch control circuit 53 then switches the switch control signals to a third state, referred to as the state "CTRL3", at the beginning of the final one-third of the horizontal period.

In response to the associated switch control signal being switched to the state "CTRL3", as shown in FIG. 8C, the switch 54 within the input switch module SWc connects the third terminal $54_3$ with the fourth terminal $54_4$, and thereby provides a connection between the node $TP_p$ and the input of the buffer amplifier $AM_{p/3}$.

Additionally, the output switch module SWb connects the second terminal $57_2$ with the first terminal $57_1$ in place of the third terminal $57_3$ within the switch 57, in response to the switch control signal being placed into the state "CTRL3". In other words, the output switch module SWb provides a connection between the output terminal $LV_{p-1}$ and the node $TP_{p-1}$ through the bypass line $58_{p/3}$, disconnecting the output of the buffer amplifier $AM_{p/3}$ from the output terminal $LV_{p-1}$.

As shown in FIG. 9, this results in that the output terminal $LV_p$ is pulled up to the voltage $V_p$ from the voltage $V_{p-1}$, while the voltages developed on the output terminals $LV_{p-2}$ and $LV_{p-1}$ are maintained at the voltages $V_{p-2}$ and $V_{p-1}$, respectively.

It should be noted that the order in which the voltages $V_p$, $V_{p-1}$, and $V_{p-2}$ are developed on the outputs terminals $LV_p$, $LV_{p-1}$, and $LV_{p-2}$ is preferably dependent on the level of the common voltage $V_{COM}$. As described above, for a horizontal period during which the common voltage $V_{COM}$ is pulled down to ground, the input switch module SWc selects the voltage $V_{p-2}$ to output to the input of the buffer amplifier $AM_{p/3}$ during the first one-third of the horizontal period, and then selects the voltage $V_{p-1}$ during the second one-third of the horizontal period, and finally selects the voltage $V_p$ during the final one-third of the horizontal period.

For a horizontal period during which the common voltage $V_{COM}$ is pulled up to a power supply voltage, higher than the voltage $V_n$, the order in which the voltages $V_p$, $V_{p-1}$, and $V_{p-2}$ are selected by the input switch module SWc is reversed.

Specifically, the input switch module SWc selects the voltage $V_p$ during the first one-third of the horizontal period, while the output switch module SWb provides connections between the output of the buffer amplifier $AM_{j/2}$ and all of the output terminals $LV_{p-2}$, $LV_{p-1}$, and $LV_p$. This results in that all of the output terminals $LV_{p-2}$, $LV_{p-1}$, and $LV_p$ are driven to the voltage $V_p$.

During the second one-third of the horizontal period, the input switch module SWc selects the voltage $V_{p-1}$, while the output switch module SWd provides a connection between only the output terminals $LV_{p-1}$ and $LV_{p-2}$ and the output of the buffer amplifier $AM_{p/2}$; the output terminal $LV_p$ is disconnected from the output of the buffer amplifier $AM_{p/3}$, and connected to the node $LV_p$ through an additional bypass line. This results in that the output terminals $LV_{p-2}$ and $LV_{p-1}$ are driven down to the voltage $V_{p-1}$, with the output terminal $LV_p$ maintained at the voltage $V_p$.

During the final one-third of the horizontal period, the input switch module SWc selects the voltage $V_{p-2}$, while the output switch module SWd provides a connection between only the output terminal $LV_{p-2}$ and the output of the buffer amplifier $AM_{p/2}$; the output terminal $LV_{p-1}$ is additionally disconnected from the output of the buffer amplifier $AM_{p/3}$, and connected to the node $LV_{p-1}$ through the bypass line $58_{p/3}$. This results in that the output terminals $LV_{p-2}$ is driven down to the voltage $V_{p-2}$ with the output terminals $LV_p$ and $LV_{p-1}$ maintained at the voltages $V_p$ and $V_{p-1}$, respectively.

In an alternative embodiment, each horizontal period may be divided into first to third time periods having durations different from the aforementioned embodiment; the first time period, which initiates at the beginning of the horizontal period has a longer duration than those of the following second and third time periods. Specifically, for a horizontal period during which the common voltage $V_{COM}$ is pulled down to ground, the first time period, during which all of the output terminals $LV_{p-2}$, $LV_{p-1}$, and $LV_p$ are driven to the voltage $V_{p-2}$ preferably has a duration longer than the following time periods during which the output terminals $LV_{p-1}$ and $LV_p$ are driven to the voltages $V_{p-1}$ and $V_p$, respectively. Correspondingly, for a horizontal period during which the common voltage $V_{COM}$ is pulled up to the power supply voltage, the first time period during which all of the output terminals $LV_{p-2}$, $LV_{p-1}$, and $LV_p$ are driven to the voltage $V_p$ preferably has a duration longer than those of the following two time periods during which the output terminals $LV_{p-1}$ and $LV_{p-2}$ are driven to the voltages $V_{p-1}$ and $V_{p-2}$, respectively. In one preferred embodiment, the first time period has a duration equal to the half of the horizontal period (½H), and the second and third time periods each have a duration equal to one-fourth of the horizontal period (¼H).

This operation addresses providing the buffer amplifier $AM_{p/3}$ with sufficient time for driving the output terminals $LV_{p-2}$, $LV_{p-1}$, and $LV_p$ to the voltage $V_{p-2}$ (or $V_p$) at the beginning of the horizontal period. As is understood from FIG. 9, the buffer amplifier $AM_{p/3}$ requires a longer duration for the drive of the output terminals $LV_{p-2}$. $LV_{p-1}$, and $LV_p$ to the voltage $V_{p-2}$ (or $V_p$) compared to the following drives up to the voltages $V_{p-1}$ and $V_p$ (or down to the voltages $V_{p-1}$ and $V_{p-2}$).

The above-described LCD driver architecture in this embodiment provides the same advantages as that disclosed in the first embodiment. The LCD driver architecture in this embodiment is also effective for reducing the power consumption and circuit size through reducing the number of necessary buffer amplifiers. Additionally, the LCD driver architecture in this embodiment effectively avoids over-shoot of the voltages on the output terminals of the drive voltage generator circuit 50 through adopting step-by-step driving.

Figure 14:
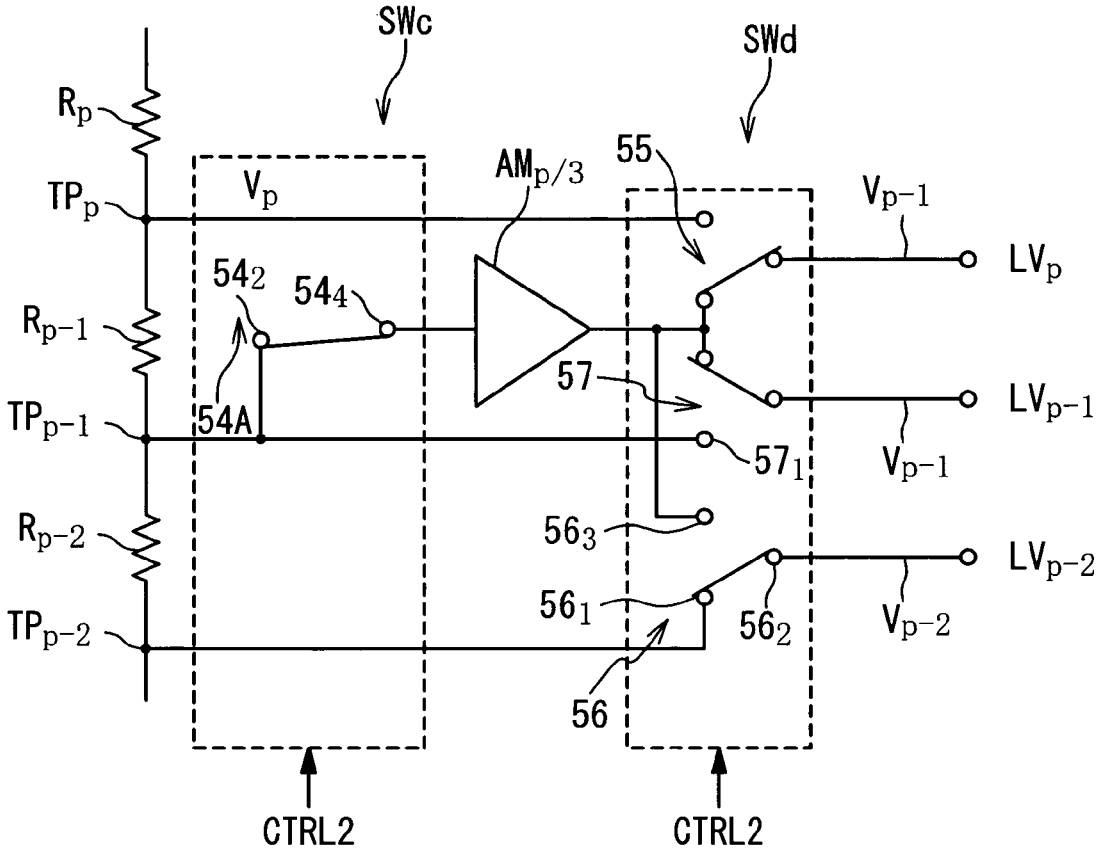
FIG. 14 is a circuit diagram illustrating a preferred structure of the buffer circuitry in the second embodiment.

In another alternative embodiment, the structure of the input and output switch modules SWc and SWd of the buffer module $M_{p/3}$ may be modified as shown in FIG. 14. In the structure shown in FIG. 14, the input switch module SWc within the buffer module $M_{p/3}$ is composed of a switch 54A that is responsive to the control signal received from the switch control circuit 43 for providing an electrical connection between the node $TP_{p-1}$ and the input of the buffer amplifier $AM_{p/2}$. The output switch module SWd additionally includes a switch 55 that is responsive to the control signal received from the switch control circuit 53 for electrically connecting selected one of the input of the buffer amplifier $AM_{p/3}$ and the node $TP_p$ to the output terminal $LV_p$.

Figure 15:
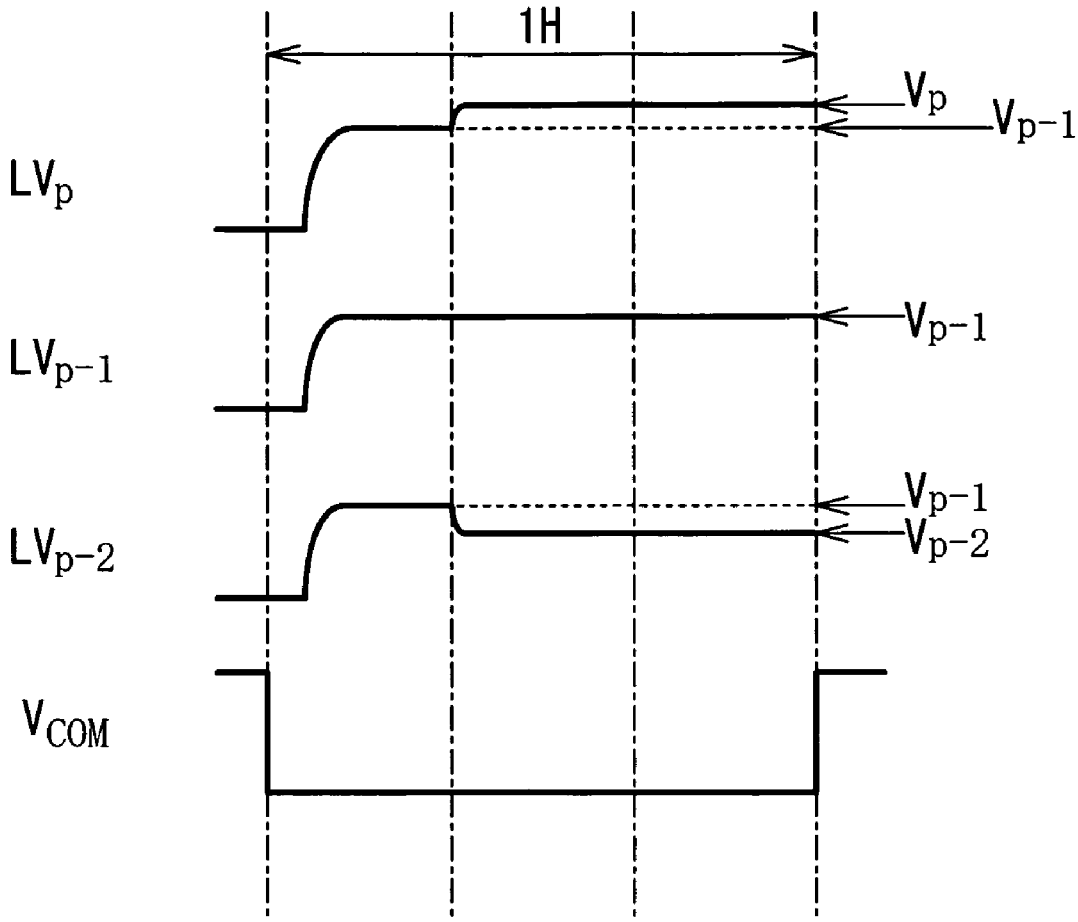
FIG. 15 is a timing chart illustrating a preferred operation of the buffer circuitry in the second embodiment.

FIG. 15 is a timing chart illustrating an exemplary operation of the buffer module $M_{p/3}$ of FIG. 14. The operation of the buffer module $M_{p/3}$ of FIG. 14 divides each horizontal period into first and second periods; the first period begins at the beginning of each horizontal period, and the second period follows the first period.

During the first period, the switch 54A within the input switch module SWc establishes an electrical connection between the node $TP_{p-1}$ to the input of the buffer amplifier $AM_{p/3}$, and the output switch module SWd establishes electrical connections between the output of the buffer amplifier $AM_{p/3}$ and all of the output terminals $LV_{p-2}$, $LV_{p-2}$, and $LV_p$. This results in that all of the output terminals $LV_p$, $LV_{p-1}$ and $LV_{p-2}$ are driven to the voltage $V_{p-1}$ by the buffer amplifier $AM_{p/3}$, during the first period.

During the second period, the switch 54A disconnects the node $TV_{p-1}$ from the input of the buffer amplifier $AM_{p/3}$. The switches 55, 56, and 57 electrically connect the nodes $TP_{p-2}$, $TP_{p-1}$, and $TP_p$ to and the corresponding output terminals $LV_{p-2}$, $LV_{p-1}$, and $LV_p$, respectively; the output of the buffer amplifier $AM_{p/3}$ is disconnected from all of the output terminals $LV_{p-2}$, $LV_{p-1}$, and $LV_p$. This results in that the output terminal $LV_{p-2}$ is driven down to the voltage $V_{p-2}$ and the output terminal $LV_p$ is driven up to the voltage $V_p$; the output terminal $LV_{p-1}$ is maintained at the voltage $V_p$.

This operation advantageously achieves further reduction in the power consumption. The aforementioned operation allows the buffer amplifier $AM_{p/2}$ to be disenabled during the second period. This effectively reduces the power consumption of the buffer module $M_{p/2}$.

It is important that the output terminals $LV_{p-2}$ to $LV_p$ are firstly driven to the voltage $V_{p-1}$, which is an intermediate voltage between the voltages $V_{p-2}$, and $V_p$. Firstly driving the output terminals $LV_{p-2}$ to $LV_p$ to the voltage $V_{p-1}$ is effective for reducing the number of the driving steps; this operation requires only two steps for driving the three output terminals $LV_{p-2}$ to $LV_p$.

It is preferable that the duration of the second period, during which the buffer amplifier $AM_{p/2}$ is disconnected from both of the output terminals $LV_{p-2}$ to and $LV_p$, is longer than that of the first period. This is because driving the output terminals $LV_{p-2}$ and $LV_p$ to the voltages $V_{p-2}$ and $V_p$, respectively, without using the buffer amplifier $AM_{p/2}$ requires longer duration compared to the duration necessary for driving the output terminals $LV_{p-2}$ to $LV_p$ using the buffer amplifier $AM_{p/3}$. In an exemplary operation, the duration of the first period is one-fifth of that of the horizontal period, while the duration of the second period is four-fifth of that of the horizontal period.

Third Embodiment

Figure 10:
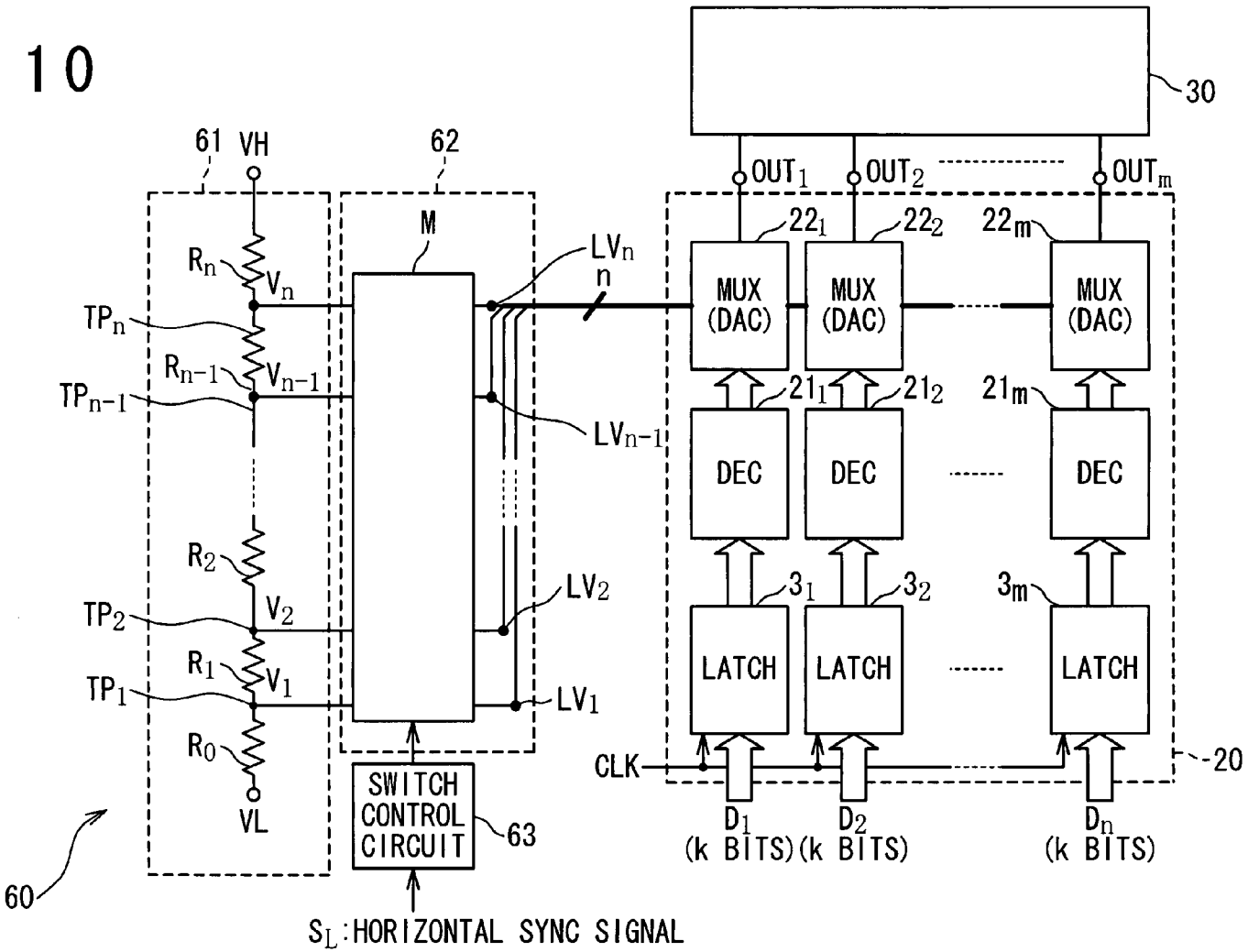
FIG. 10 is a block diagram illustrating an exemplary structure of an LCD driver in a third embodiment.

FIG. 10 illustrates an exemplary structure of a liquid crystal display apparatus in a third embodiment. The structure liquid crystal display apparatus in the third embodiment is similar to that in the first embodiment, except for that the arrangement of the drive voltage generator circuit, denoted by numeral 60. The major difference is that the drive voltage generator circuit 60 uses one buffer amplifier for driving all of the output terminals $LV_1$ to $LV_n$. A detailed description of an exemplary structure and operation of the drive voltage generator circuit 60 is given in the following.

The drive voltage generator circuit 60 is composed of a breeder 61, a buffer circuitry 62, and a switch control circuit 63.

The breeder 61 is comprised of a set of serially connected resistors $R_0$ to $R_n$ between the power supply $V_H$ and ground $V_L$ to generate n different voltages associated with grayscale levels; n being the number of available grayscale levels, equal to $2^k$, where the k is the number of data bits of each pixel data. The resistor element $R_i$ is connected to the adjacent resistor element $R_{i-1}$ with a node $TP_i$ disposed therebetween, where i is any integer ranging from 1 to n. Such connection provides different voltages $V_1$ to $V_n$ on the nodes $TP_1$ to $TP_n$. It should be noted that the voltages $V_1$ to $V_n$ satisfy the following relation:

$$V_1<V_2<\ldots<V_n.$$

Figure 11A:
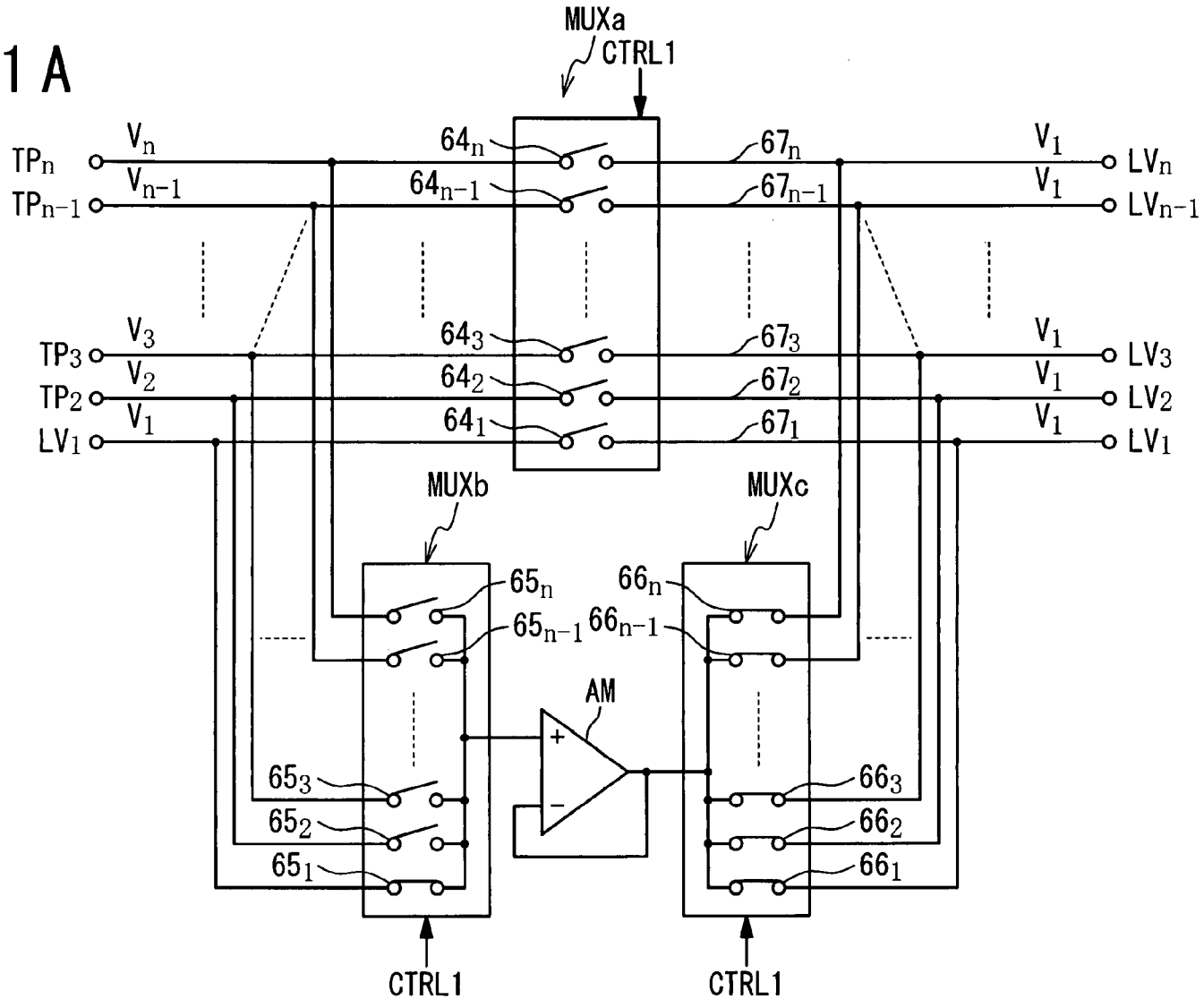
FIGS. 11A to 11C are circuit diagrams illustrating an exemplary structure and operation of a buffer circuitry disposed within the LCD driver in the third embodiment.
Figure 11B:
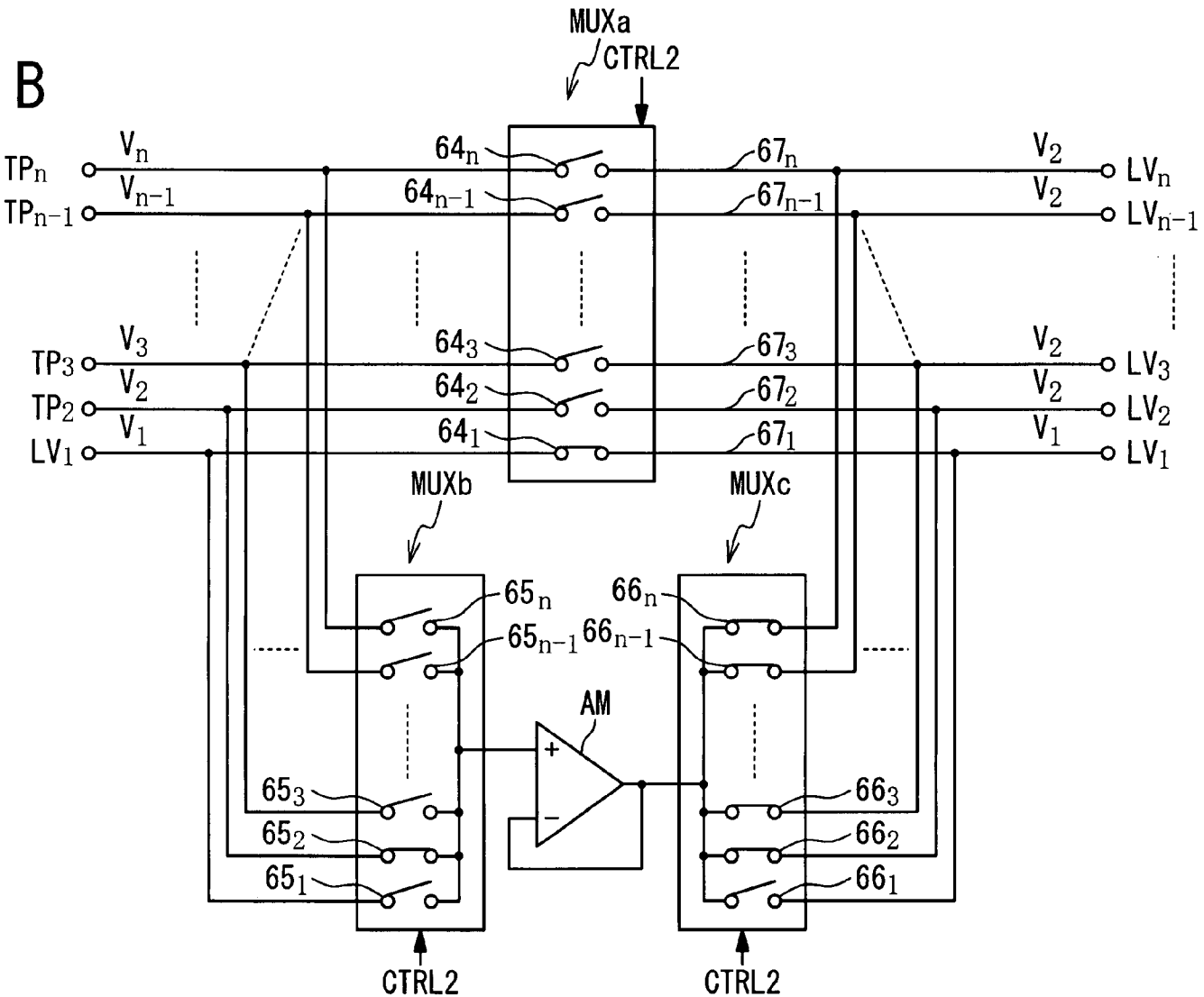
Figure 11C:
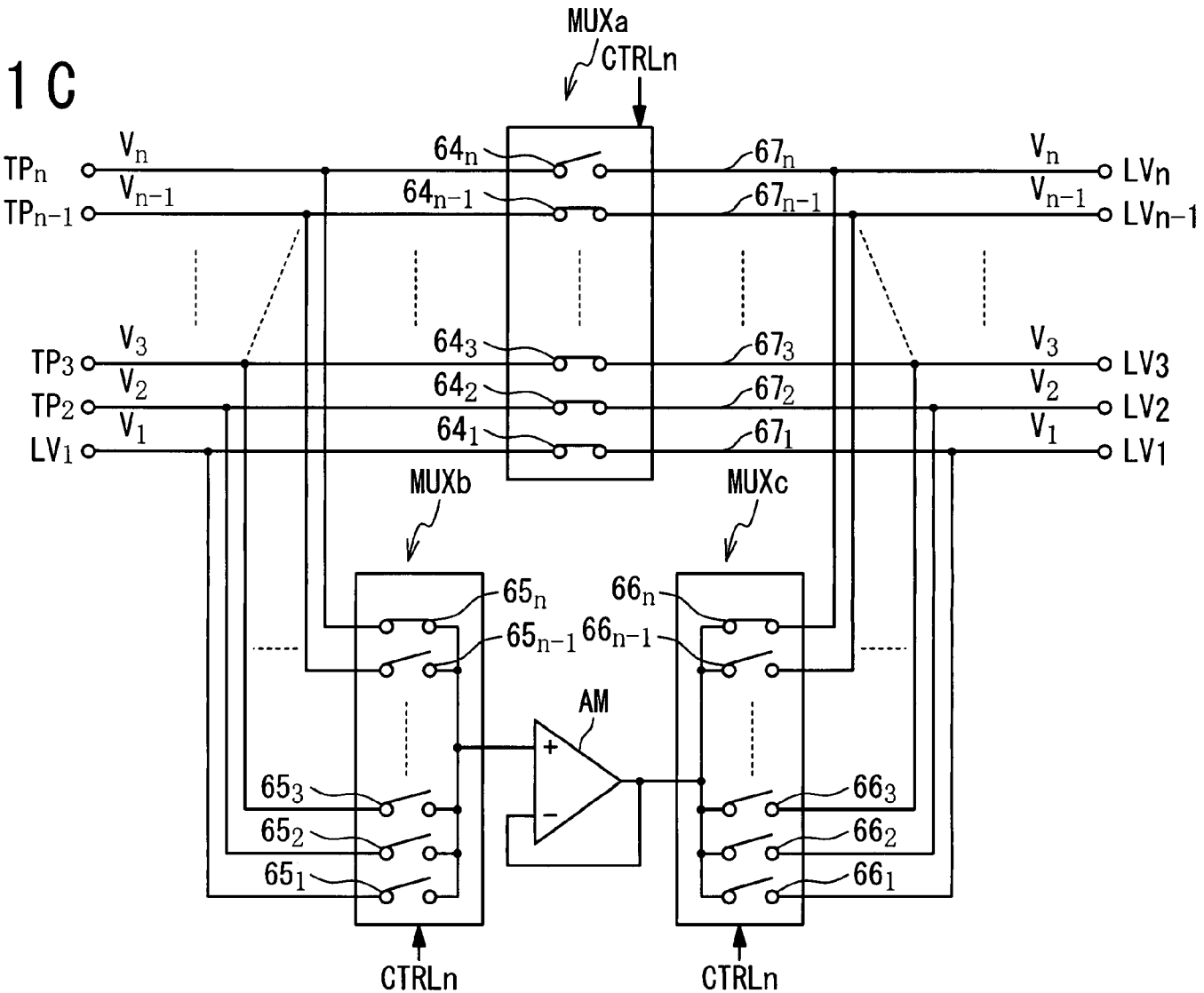

The buffer circuitry 62 is composed of a single buffer module M. As shown in FIGS. 11A to 11C, the buffer module M is composed of a bypass multiplexer MUXa, an input multiplexer MUXb, an output multiplexer MUXc, and one buffer amplifier AM having a gain of 1.

The bypass multiplexer MUXa is inserted into a set of bypass lines $\mathbf{67}_1$ to $\mathbf{67}_n$ connected between the nodes $TP_1$ to $TP_n$ and the output terminals $LV_1$ to $LV_n$. The bypass multiplexer MUXa is composed of a set of switches $\mathbf{64}_1$ to $\mathbf{64}_n$ that are disposed between the nodes $TP_1$ to $TP_n$ and the output terminals $LV_1$ to $LV_n$, respectively. The bypass multiplexer MUXa are designed to receive the voltages $V_1$ to $V_n$ from the nodes $TP_1$ to $TP_n$, and to transfer selected one(s) of the voltages $V_1$ to $V_n$ to the associated one(s) of the output terminals $LV_1$ to $LV_n$.

The input multiplexer MUXb is connected between the nodes $TP_1$ to $TP_n$ and the input of the buffer amplifier AM. The input multiplexer MUXb is composed of a set of switches $\mathbf{65}_1$ to $\mathbf{65}_n$ connected between the input of the buffer amplifier AM, and the nodes $TP_1$ to $TP_n$ respectively. The input multiplexer MUXb is designed to provide selected one of the voltages $V_1$ to $V_n$ to the input of the buffer amplifier AM.

The output multiplexer MUXc is connected between the output of the buffer amplifier AM and the output terminals $LV_1$ to $LV_n$. The output multiplexer MUXc is composed of a set of switches $\mathbf{66}_1$ to $\mathbf{66}_n$ connected between the output of the buffer amplifier AM, and the output terminals $LV_1$ to $LV_n$, respectively. The output multiplexer MUXc is designed to connect the output of the buffer amplifier AM with selected one(s) of the output terminals $LV_1$ to $LV_n$, which are connected to the drive circuitry 20.

The switch control circuit 63 is responsive to an externally inputted horizontal sync signal $S_L$ for providing a switch control signal for each of the bypass, input, and output multiplexers MUXa, MUXb and MUXc. The bypass multiplexer MUXa is responsive to the switch control signal received from the switch control circuit 63 for switching connections between the nodes $TP_1$ to $TP_n$ and the output terminals $LV_1$ to $LV_n$. Correspondingly, the input multiplexer MUXb is responsive to the switch control signal received from the switch control circuit 63 for switching connections between the nodes $TP_1$ to $TP_n$ and the input of the buffer amplifier AM, while the output multiplexer MUXc is responsive to the switch control signal received from the switch control circuit 63 for switching connections between the output of the buffer amplifier AM and the output terminals $LV_1$ to $LV_n$.

Figure 12:
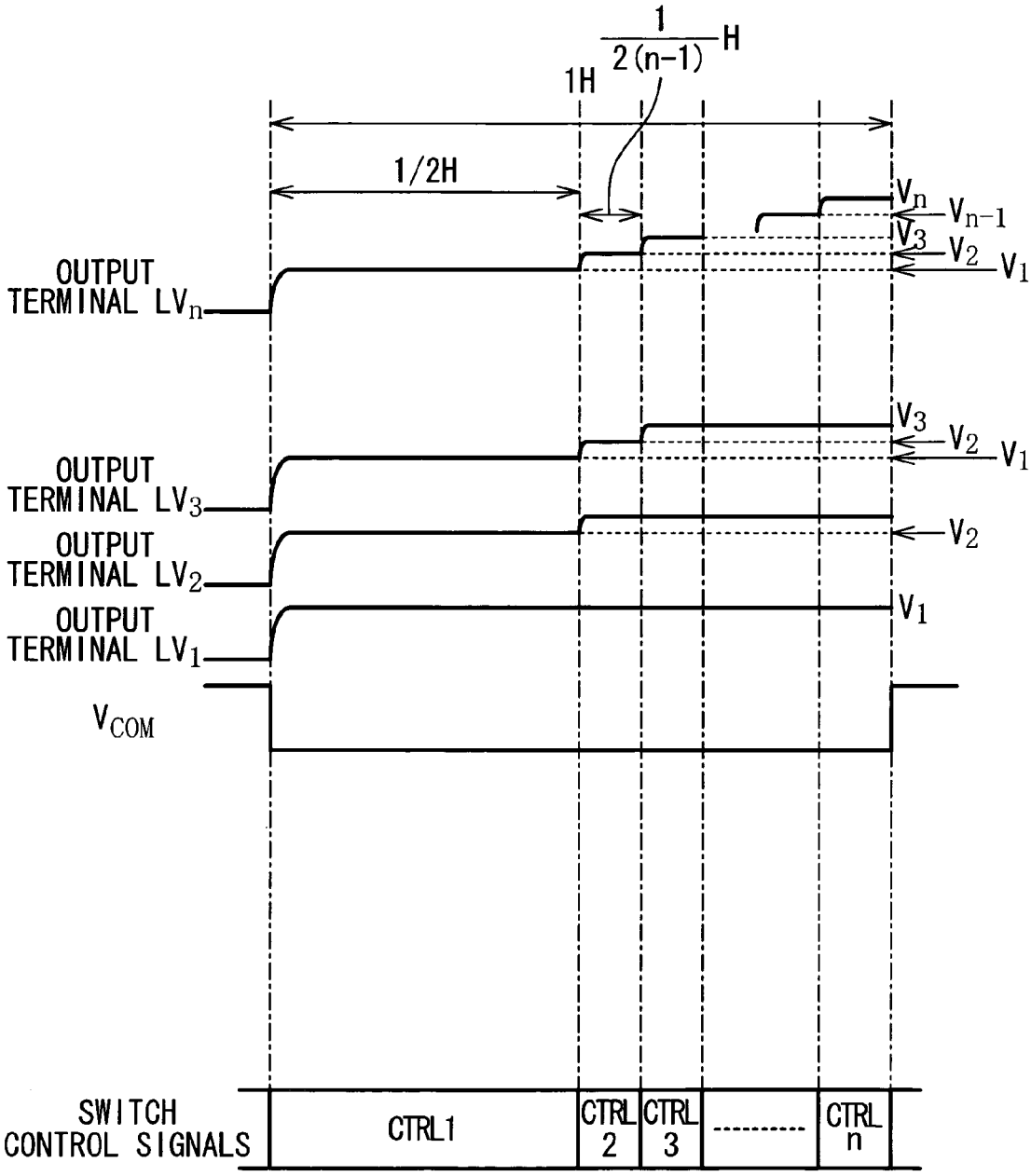
FIG. 12 is a timing chart illustrating the operation of the buffer circuitry in the third embodiment.

FIG. 12 is a timing chart illustrating an exemplary operation of the buffer module M and the switch control circuit 63. The operation in this embodiment divides each horizontal period into first to n-th time periods so that the first time period has a duration longer than the following time periods. As described later, this is effective for providing the buffer amplifier AM with efficient time for driving the output terminals $LV_1$ to $LV_n$. In one embodiment, the first time period has a duration equal to the half of the horizontal period (½H), and the remaining time periods (that is, the second to n-th time periods) has a duration of ½(n−1) times the horizontal period (½(n−1)H).

At the beginning of the first time period, as shown in FIG. 12, the horizontal sync signal $S_L$ is activated, and the common voltage $V_{COM}$ is switched on the common electrode of the LCD panel 30; the common voltage $V_{COM}$ is pull down to ground in this operation.

In response to the activation of the horizontal sync signal $S_L$, the switch control circuit 63 switches the switch control signals provided for the bypass, input, and output multiplexers MUXa, MUXb, and MUXc to a first state, referred to as the state "CTRL1", at the beginning of the first time period within the horizontal period.

In response to the switch control signals being placed into the state "CTRL1", as shown in FIG. 11A, the bypass, input, and output multiplexers MUXa, MUXb, and MUXc switch connections among the nodes $TP_1$ to $TP_n$, the buffer amplifier AM, and the output terminals $LV_1$ to $LV_n$. Specifically, the input multiplexer MUXb connects the node $TP_1$, on which the voltage $V_1$ is developed, to the input of the buffer amplifier AM, and the output multiplexer MUXc connects the output of the buffer amplifier AM to all of the output terminals $LV_1$ to $LV_n$. Additionally, the bypass multiplexer MUXa disconnects all of the nodes $TP_1$ to $TP_n$ from the output terminals $LV_1$ to $LV_n$.

As shown in FIG. 12, this results in that all of the output terminals $LV_1$ to $LV_n$ are driven up to the voltage $V_1$ by the buffer amplifier AM, during the first time period within the horizontal period.

The switch control circuit 63 then switches the switch control signals to a second state, referred to as the state "CTRL2", at the beginning of the second time period within the horizontal period.

In response to the switch control signals being placed into the state "CTRL2", as shown in FIG. 11B, the bypass, input, and output multiplexer MUXa, MUXb, and MUXc then switch connections among the nodes $TP_1$ to $TP_n$, the buffer amplifier AM, and the output terminals $LV_1$ to $LV_n$, as described in the following: The input multiplexer MUXb connects the node $TP_2$, on which the voltage $V_2$ is developed, to the input of the buffer amplifier AM, disconnecting the remaining nodes TP1, and TP3 to TPn from the input of the buffer amplifier AM. The output multiplexer MUXc connects the output of the buffer amplifier AM to the output terminals $LV_2$ to $LV_n$, disconnecting the output terminal $LV_1$ from the output of the buffer amplifier AM. Additionally, the bypass multiplexer MUXa connects the node $TP_1$ to the output terminal $LV_1$, disconnecting the remaining nodes $TP_2$ to $TP_n$ from the remaining output terminals $LV_2$ to $LV_n$.

As shown in FIG. 12, this results in that the output terminals $LV_2$ to $LV_n$ are driven up to the voltage $V_2$ by the buffer amplifier AM during the first time period within the horizontal period, while the output terminal $LV_1$ is maintained at the voltage $V_1$.

The same goes for the following time periods. At the beginning of the i-th time period, the switch control circuit 63 switches the switch control signals to the i-th state "CTRLi"; i is any integer ranging from 3 to n. In response to the switching of the switch control signals, the bypass multiplexer MUXa, the input multiplexer MUXb, the output multiplexer MUXc then switch connections among the nodes $TP_1$ to $TP_n$, the buffer amplifier AM, and the output terminals $LV_1$ to $LV_n$. Specifically, the input multiplexer MUXb connects the node $TP_i$, on which the voltage $V_i$ is developed, to the input of the buffer amplifier AM, disconnecting the remaining nodes from the input of the buffer amplifier AM. The output multiplexer MUXc connects the output of the buffer amplifier AM to the output terminals $LV_i$ to $LV_n$, disconnecting the output terminals $LV_1$ to $LV_{i-1}$ from the output of the buffer amplifier AM. Additionally, the bypass multiplexer MUXa connects the nodes $TP_1$ to $TP_{i-1}$ to the output terminals $LV_1$ to $LV_{i-1}$, respectively, disconnecting the remaining nodes $TP_i$ to $TP_n$ from the remaining output terminals $LV_i$ to $LV_n$.

As shown in FIG. 12, this results in that the output terminals $LV_i$ to $LV_n$ are driven up to the voltage $V_i$ by the buffer amplifier AM during the i-th time period within the horizontal period, while the output terminals $LV_1$ to $LV_{i-1}$ are maintained at the voltages $V_1$ to $V_{i-1}$, respectively.

As illustrated in FIG. 11C, this procedure eventually provides the voltages $V_1$ to $V_n$ on the output terminals $LV_1$ to $LV_n$, respectively, during the final n-th time period.

It should be noted that the order in which the voltages $V_1$ to $V_n$ are developed on the outputs terminals $LV_1$ to $LV_n$ is preferably dependent on the level of the common voltage $V_{COM}$. As described above, for a horizontal period during which the common voltage $V_{COM}$ is pulled down to ground, the buffer module M develops the voltage $V_1$ on all of the output terminals $V_1$ to $V_n$ during the first time period, and then develops the voltage $V_2$ on the output terminals $V_2$ to $V_n$ with the output terminal $V_1$ maintained at the voltage $V_1$, during the second time period. The same goes for the following time period.

For a horizontal period during which the common voltage $V_{COM}$ is pulled up to a power supply voltage, higher than the voltage $V_n$, the order in which the voltages $V_1$ to $V_n$ are developed on the outputs terminals $LV_1$ to $LV_n$ is reversed.

Specifically, during the first time period, the input multiplexer MUXb connects the node $TP_n$, on which the voltage $V_n$ is developed, to the input of the buffer amplifier AM, disconnecting the remaining nodes $TP_1$ to $TP_{n-1}$ from the input of the buffer amplifier AM. The output multiplexer MUXc connects the output of the buffer amplifier AM to all of the output terminals $LV_1$ to $LV_n$. Additionally, the bypass multiplexer MUXa disconnects all of the nodes $TP_1$ to $TP_n$ from the output terminals $LV_1$ to $LV_n$. This results in that all of the output terminals $LV_1$ to $LV_n$ are driven to the voltage $V_n$.

During the second time period, the input multiplexer MUXb connects the node $TP_{n-1}$, on which the voltage $V_{n-1}$ is developed, to the input of the buffer amplifier AM, disconnecting the remaining nodes $TP_1$ to $TP_{n-2}$, and $TP_n$ from the input of the buffer amplifier AM. The output multiplexer MUXc connects the output of the buffer amplifier AM to the output terminals $LV_1$ to $LV_{n-1}$, disconnecting the output terminal $LV_n$ from the output of the buffer amplifier AM. Additionally, the bypass multiplexer MUXa connects the node $TP_n$ to the output terminal $LV_n$, disconnecting the remaining nodes $TP_1$ to $TP_{n-1}$ from the remaining output terminals $LV_1$ to $LV_{n-1}$. This results in that the output terminals $LV_1$ to $LV_{n-1}$ are driven down to the voltage $V_{n-1}$, with the output terminal $LV_n$ maintained at the voltage $V_n$.

The same goes for the following time period. During the i-th time period with i being any integer ranging from 3 to n, the input multiplexer MUXb connects the node $TP_{n-i+}1$, on which the voltage $V_{n-i+}1$ is developed, to the input of the buffer amplifier AM, disconnecting the remaining nodes $TP_1$ to $TP_{n-i}$, and $TP_{n-i+2}$ to $TP_n$ from the input of the buffer amplifier AM. The output multiplexer MUXc connects the output of the buffer amplifier AM to the output terminals $LV_1$ to $LV_{n-i+1}$, disconnecting the output terminals $LV_{n-1+2}$ to $LV_n$ from the output of the buffer amplifier AM. Additionally, the bypass multiplexer MUXa connects the node $TP_{n-1+2}$ to $TP_1$ to the output terminals $TP_{n-i+2}$ to $TP_n$, disconnecting the remaining nodes $TP_1$ to $TP_{n-i+1}$ from the remaining output terminals $TP_1$ to $TP_{n-i+1}$. This results in that the output terminals $LV_1$ to $LV_{n-i+1}$ are driven down to the voltage $V_{n-i+1}$, with the output terminals $TP_{n-i+2}$ to $TP_n$ maintained at the voltages $V_{n-i+2}$ to $V_n$, respectively.

Although the invention has been described in its preferred form with a certain degree of particularity, it is understood that the present disclosure of the preferred form has been changed in the details of construction and the combination and arrangement of parts may be resorted to without departing from the scope of the invention as hereinafter claimed.

Especially, it should be noted that the buffer circuitry architecture shown in FIGS. 11A to 11C is applicable to the buffer modules $M_1$ to $M_{n/2}$ shown in FIG. 4, and also applicable to the buffer modules $M_1$ to $M_{(n-\alpha)/3}$ shown in FIG. 7. Those skilled in the art would appreciate that the buffer circuitry shown in FIGS. 11A to 11C with n=2 provides the same function as each buffer modules $M_{j/2}$ shown in FIG. 4, and the buffer circuitry shown in FIGS. 11A to 11C with n=3 provides the same function as each buffer module $M_{p/3}$ shown in FIG. 7.

What is claimed is:

1. A drive voltage generator circuit comprising:

a breeder developing a set of first to N-th different voltages on first to N-th nodes, respectively, N being any integer equal to or more than 2, and said first to N-th voltages being associated with grayscale levels, respectively;

a buffer amplifier;

a set of first to N-th output terminals through which drive voltages are provided for an LCD panel; and a switch circuitry that switches connections among an input and an output of said buffer amplifier, said first to N-th nodes, and said first to N-th output terminals, wherein each horizontal period is divided into first to N-th time periods, wherein said first to N-th voltages satisfy the following relation:

$V_1<V_2< \ldots <V_N$, where $V_i$ is a level of said i-th voltage, wherein, during a first time period within a first horizontal period during which a common electrode within said LCD panel is pulled down to ground, said switch circuitry connects said first node to said input of said buffer amplifier, and connects said output of said buffer amplifier to all of said first to N-th output terminals, wherein, during an i-th time period within said first horizontal period with i being any integer ranging from 2 to N, said switch circuitry connects said i-th node to said input of said buffer amplifier, connects said output of said buffer amplifier to said i-th to N-th output terminals, disconnecting said first to (i−1)-th output terminals from said output of said buffer amplifier, and connects said first to (i−1)-th nodes to said first to (i−1)-th output terminals, respectively, wherein, during a first time period within a second horizontal period during which a common electrode within said LCD panel is pulled up to a voltage, said switch circuitry connects said N-th node to said input of said buffer amplifier, and connects said output of said buffer amplifier to all of said first to N-th output terminals, and wherein, during an i-th time period within said second horizontal period, said switch circuitry connects said (N−i+1)-th node to said input of the buffer amplifier, connects the output of the buffer amplifier to said first to (N−i+1)-th output terminals, disconnecting said (N−i+2)-th to N-th output terminals from said output of the buffer amplifier, and connects said (N−i+2)-th to N-th nodes to said (N−i+2)-th to N-th terminals.

2. The drive voltage generator circuit according to claim 1, wherein said switch circuitry includes:

an input multiplexer module for connecting selected one of said first to N-th node to said input of said buffer amplifier, an output multiplexer module for connecting said output of said buffer amplifier to selected one(s) of said first to N-th output terminals, and a bypass multiplexer module for connecting selected one(s) of said first to N-th node to associated one(s) of said first to N-th output terminals.

3. An LCD driver comprising:

the drive voltage generator circuit according to claim 1; and an output selector circuit designed to select one of said drive voltages in response to pixel data, and to output said selected drive voltage to associated one of signal lines within an LCD panel.

4. The drive voltage generator circuit according to claim 3, wherein said first time period has a duration longer than that of said second time period.

5. The drive voltage generator circuit according to claim 3, wherein said first time period has a duration longer than those of said second to N-th time periods.

6. A liquid crystal display apparatus comprising:

an LCD panel including signal lines;

drive voltage generator circuit according to claim 1; and an output selector circuit designed to select one of said drive voltages in response to pixel data, and to output said selected drive voltage to associated one of said signal lines.

7. A drive voltage generator circuit comprising:

a breeder developing a set of first to N-th different voltages on first to N-th nodes, respectively, N being any integer equal to or more than 2, and said first to N-th voltages being associated with grayscale levels, respectively;

a buffer amplifier;

a set of first to N-th output terminals through which drive voltages are provided for an LCD panel; and a switch circuitry that switches connections among an input and an output of said buffer amplifier, said first to N-th nodes, and said first to N-th output terminals, wherein said switch circuitry includes:

an input multiplexer module for connecting selected one of said first to N-th node to said input of said buffer amplifier, an output multiplexer module for connecting said output of said buffer amplifier to selected one(s) of said first to N-th output terminals, and a bypass multiplexer module for connecting selected one(s) of said first to N-th node to associated one(s) of said first to N-th output terminals, wherein a first time period, said input multiplexer module connects said first node to said input of said buffer amplifier, and said output multiplexer module connects said output of said buffer amplifier to all of said first to N-th output terminals, and said bypass multiplexer module disconnects said first to N-th nodes from said first to N-th output terminals, and wherein, during an i-th time period with i being any integer ranging from 2 to N, said input multiplexer module connects said i-th node $TP_i$ to said input of said buffer amplifier, and said output multiplexer module connects said output of said buffer amplifier to said i-th to N-th output terminals, disconnecting said first to (i−1)-th output terminals from said output of said buffer amplifier, and said bypass multiplexer module connects said first to (i−1)-th nodes to said first to (i−1)-th output terminals, respectively, disconnecting said i-th to N-th nodes from said i-th to N-th output terminals.

8. An LCD driver comprising:

the drive voltage generator circuit according to claim 7; and an output selector circuit designed to select one of said drive voltages in response to pixel data, and to output said selected drive voltage to associated one of signal lines within an LCD panel.

9. A liquid crystal display apparatus comprising:

an LCD panel including signal lines;

drive voltage generator circuit according to claim 7; and an output selector circuit designed to select one of said drive voltages in response to pixel data, and to output said selected drive voltage to associated one of said signal lines.

* * * * *